US007730643B2

(12) United States Patent
Mishra et al.

(10) Patent No.: US 7,730,643 B2
(45) Date of Patent: Jun. 8, 2010

(54) TWO-STAGE SNOW PLOW

(75) Inventors: Amiya Mishra, Guelph (CA); Gerald Simpson, Gowanstown (CA); William John Reeves, Mt. Forest R4 (CA)

(73) Assignee: Cives Corporation, Roswell, GA (US)

( * ) Notice: Subject to any disclaimer, the term of this patent is extended or adjusted under 35 U.S.C. 154(b) by 957 days.

(21) Appl. No.: 11/438,442

(22) Filed: May 23, 2006

(65) Prior Publication Data

US 2007/0271828 A1 Nov. 29, 2007

(51) Int. Cl.
*E01H 5/04* (2006.01)
*E01H 4/00* (2006.01)

(52) U.S. Cl. ..... 37/266; 37/221

(58) Field of Classification Search ..... 37/231–233, 37/266, 268, 241, 407, 446, 460, 219–222; 172/684.5, 765, 766, 810, 811, 817
See application file for complete search history.

(56) References Cited

U.S. PATENT DOCUMENTS

| | | | | |
|---|---|---|---|---|
| 338,262 | A | 3/1886 | Gibson | |
| 520,479 | A | 5/1894 | Bunnell | |
| 1,383,409 | A | 7/1921 | Liddell | |
| 2,061,585 | A | 11/1936 | Meyer | |
| 2,116,351 | A | 5/1938 | Jones et al. | |
| 2,337,434 | A | 12/1943 | Washbond | |
| 2,962,821 | A | 12/1960 | Peitl | |
| 3,199,234 | A | 8/1965 | Reissinger | |
| 3,772,803 | A | 11/1973 | Cote | |
| 4,259,794 | A * | 4/1981 | Rath | 37/233 |
| 4,669,205 | A | 6/1987 | Smathers | |
| 4,671,363 | A | 6/1987 | Bolinger | |
| 4,709,492 | A | 12/1987 | Watson | |
| 4,794,710 | A | 1/1989 | Häring | |
| 4,843,744 | A | 7/1989 | Jansen | |

(Continued)

FOREIGN PATENT DOCUMENTS

| | | |
|---|---|---|
| CA | 1219120 | 3/1987 |

(Continued)

OTHER PUBLICATIONS

Protest filed Mar. 13, 2009 in the Canadian Patent Office by Gowling Lafleur Henderson LLP, regarding Canadian Patent Appln. 2,547,840.

*Primary Examiner*—Robert E Pezzuto
(74) *Attorney, Agent, or Firm*—Buchanan Ingersoll & Rooney PC

(57) ABSTRACT

A snow plow includes a primary moldboard and auxiliary plow positioned behind the primary moldboard. The snow plow may be a one-way or reversible snow plow. In the later case, the primary moldboard and auxiliary plow are attached to a drive frame that is rotatable about a frame. The frame is secured to the front of a vehicle by a frame and bracket, and controlled by hydraulic mechanisms. The auxiliary plow is operated independently of the moldboard by a pair of hydraulic cylinders and includes tines or a resilient blade for clearing snow and ice that is not taken up by the primary moldboard. The device also includes a mechanism whereby the scraping edge of the secondary plow follows the same path as the scraping edge of moldboard by sliding movement of the secondary plow relative to the drive frame, and the blade of the auxiliary plow may be formed by tines or a resilient blade.

49 Claims, 14 Drawing Sheets

U.S. PATENT DOCUMENTS

| | | | | | |
|---|---|---|---|---|---|
| D310,225 | S | | 8/1990 | Eberle | |
| 5,079,866 | A | | 1/1992 | Farrell | |
| 5,140,763 | A | | 8/1992 | Nichols, IV | |
| 5,142,855 | A | | 9/1992 | Guidarelli | |
| 5,471,770 | A | | 12/1995 | Ferreira | |
| 5,497,569 | A | | 3/1996 | Byman | |
| 5,819,443 | A | * | 10/1998 | Winter | 37/233 |
| 6,256,910 | B1 | * | 7/2001 | Grozde | 37/266 |
| 6,996,925 | B2 | * | 2/2006 | Harding | 37/405 |
| 7,146,754 | B2 | * | 12/2006 | Schultz et al. | 37/231 |

FOREIGN PATENT DOCUMENTS

| | | |
|---|---|---|
| CA | 1291872 | 11/1991 |
| CA | 2125586 | 10/1998 |

* cited by examiner

TWO-STAGE SNOW PLOW

FIELD OF THE INVENTION

The present invention relates to plows and more particularly relates to plowing arrangements for clearing snow from pavement such as a road, a highway or a runway as well as to methods of clearing snow from pavement.

BACKGROUND OF THE INVENTION

An accumulation of snow is usually removed from pavement by a truck that is provided with a snowplow having a moldboard mounted on the front end of the truck. Typically, the plowing operation leaves some amount of snow or ice or slush on the pavement being cleared. When the snow or ice is packed down on the pavement surface, the ability of the moldboard to remove all or substantially all of the snow and ice is significantly reduced.

During a plowing operation, it is conventional to raise and lower the moldboard of the snow plow as desired and to change the angle that the moldboard of the snow plow makes with the longitudinal center axis of the truck, and therefore with respect to the longitudinal axis of the lane of pavement being cleared.

The moldboard of the snow plow may be selectively raised and lowered so that the plow truck may be driven with the lowermost edge of the moldboard either in contact (for conducting a plowing operation) or out of contact with the road, such as when the truck is being driven over pavement which has already been cleared of snow. Also, the snow plow is typically arranged to enable the angle of the plow with respect to the truck to be changed so that the snow plow can be used to divert snow to the left or to the right of the truck or used to push snow directly in front of the truck such as when clearing a driveway or parking lot.

A wing plow or another attachment may be provided to effectively extend the width of the lane that can be plowed by a single truck in a single pass. Such wing plows are typically mounted at one side of the truck.

Snow plow vehicles at airfields may sometimes have a front plow blade and a broom which is towed by the vehicle.

The need remains for a snowplow arrangement in which some or essentially all of the snow, ice and slush which has been left by the moldboard may be removed from the pavement being plowed in a single pass of a snowplow vehicle.

SUMMARY OF THE INVENTION

These and other needs are met by the invention. In one embodiment, a snow plow for mounting to a vehicle includes a first frame, a second frame coupled to the first frame for rotation about the first frame, a main plow having a scraping edge and mounted to the second frame, a secondary plow, and a member that couples the secondary plow to the second frame and configured to allow translation of the secondary plow relative to the second frame and in a direction that is parallel to the main plow scraping edge. One example of the member for coupling is sleeves provided on the second frame. These sleeves have bearing surfaces upon which the secondary plow slides as it translates in the parallel direction. A linkage may also be provided which, when combined with the member, allows the secondary plow to translate. The linkage is connected at one end to the secondary plow and at the other end to the first frame. In another embodiment, the member may be formed by a gear train where portions of the gear train are located on the drive frame and the secondary plow.

In another embodiment, a snow plow for mounting to a vehicle includes a drive frame, a main plow coupled to the drive frame, and a secondary plow coupled to the drive frame and positioned behind the main plow, wherein the secondary plow includes a plurality of fingers, each having a straight portion and a curved portion wherein the curved portion is adapted for collecting snow. Each of the tines may be a one piece tine, or a two piece tine. For a two piece tine, the straight portion may be formed by spring steel while a scraping tip may be formed of carbide.

In another embodiment, a snow plow for mounting to a vehicle includes a drive frame, a main plow coupled to the drive frame, a secondary plow coupled to the drive frame and positioned behind the main plow, and a remotely controlled actuator, mounted to the drive frame and configured for selectively placing the secondary plow into a plowing position. The actuator may be a hydraulic cylinder.

In another embodiment, a method for deploying a snow plow mounted to the front of a vehicle includes the steps of lowering a main plow so as to bring it into a plowing position, and lowering a secondary plow, located between the vehicle and the main plow, so as to bring the secondary plow into the plowing position. In this method, the secondary plow may be placed in a plowing position after the main plow has begun plowing. The plows may be raised/lowered by hydraulic cylinders. Further, both plows may have separate hydraulic cylinders and the pressure applied to the secondary plow by its hydraulic cylinder may be remotely controlled by an operator-enabled valve so that as tines of the secondary plow blade begin to erode, the operator can increase the pressure applied to the tines.

In another embodiment, a method for positioning a snow plow at the commencement of snow plowing includes the steps of rotating a main plow relative to a vehicle carrying the main plow and translating a secondary plow, positioned between the main plow and the vehicle, in a direction parallel to a scraping edge of the main plow. In this embodiment, the secondary plow may be translated by allowing it to freely slide along bearing surfaces which may be formed on a drive frame. Additionally, the steps may include lowering the main and secondary plows after the rotating and translating steps.

In another embodiment, a method for snow plowing using a vehicle having a snow plow attached at a front end of the vehicle includes the steps of providing a first plow in a stowed position, providing a second plow that is located between the first plow and the vehicle, and lowering the second plow so as to place it into a plowing position while maintaining the first plow in the stowed position.

In another embodiment, a method for adding a secondary plow to an existing plowing apparatus, the plowing apparatus having a frame, a main plow supported by the frame, and a bracket for securing the frame to a front end of a vehicle, includes the steps of providing a secondary plow blade, an actuator having a first end and a second end, and an actuator mount, securing the actuator mount to the frame, coupling the secondary plow to the frame for pivotal motion relative to the frame and attaching the actuator first end to the actuator mount and a second end to the secondary plow blade. In this method, the conventional frame for the main plow may provide adequate clearance for operating the secondary plow, or it may require a modification to the frame.

Additional features and advantages of the invention will be set forth or be apparent from the description that follows. The features and advantages of the invention will be realized and attained by the structures and methods particularly pointed out in the written description and claims hereof as well as the appended drawings. It is to be understood that both the foregoing general description and the following detailed description are exemplary and explanatory and are intended to provide further explanation without limiting the scope of the invention as claimed.

BRIEF DESCRIPTION OF THE DRAWING FIGURES

Several preferred embodiments of the invention are illustrated in the enclosed figures in which.

DETAILED DESCRIPTION OF THE PREFERRED EMBODIMENTS

Figure 1:
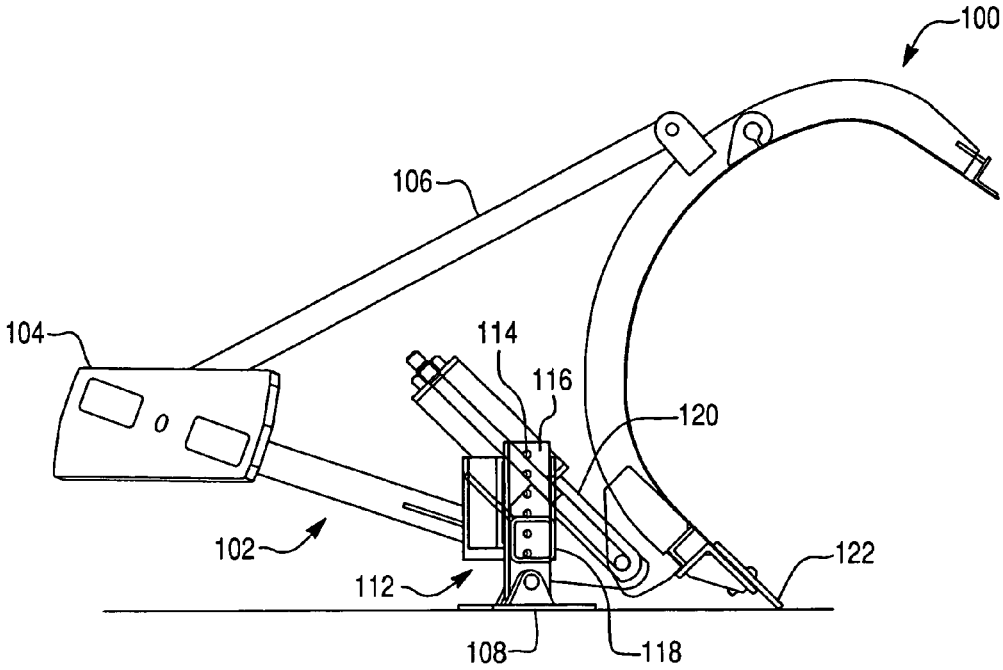
Fig. 1 Prior Art
FIG. 1 is a side view of a snow plow according to the prior art with the plow in contact with the pavement.

With reference to FIG. 1, a snow plow according to the prior art is shown with a moldboard 100 of conventional design which is carried by a truss 102. The truss 102 is arranged to be removably mounted on the front of a truck or other suitable vehicle (not shown) through a bracket 104 in a suitable and conventional manner well known in the art. A back brace 106 is provided to support an upper portion of the moldboard 100.

An arrangement 108 including a plow shoe 108 and vertical member 112 is provided behind the moldboard 100. The vertical member 112 has a plurality of holes 114 which correspond to holes in a bracket 116 so that the plow shoe may be adjusted vertically to provide a support for the moldboard on the pavement.

The truss 102 has a mounting member 118 which is formed from steel square tubing and which comprises a box beam, i.e., a member having a square cross-section, which is hollow along the length of the box beam. The moldboard 100 is pivotally attached to the mounting member 118 by a bracket 120. Typically, the back brace 106 is formed by a pair of hydraulic cylinders which are provided to selectively orient the moldboard 100 with respect to the truss 102. In this way, the angle that the moldboard makes with respect to the pavement may be varied as desired. In addition, the truss 102 includes an arrangement (not shown) such as one or more hydraulic cylinders to lift the moldboard 100 when desired.

If desired, the scraping edge 122 of the moldboard 100 may be made of a flexible or resilient material in order to minimize damage to the moldboard in the event that the cutting edge 122 should strike an obstruction during plowing. The cutting edge 122 may also be provided with a trip mechanism such as is described in U.S. Pat. No. 5,079,866, which is incorporated herein by reference.

Figure 2:
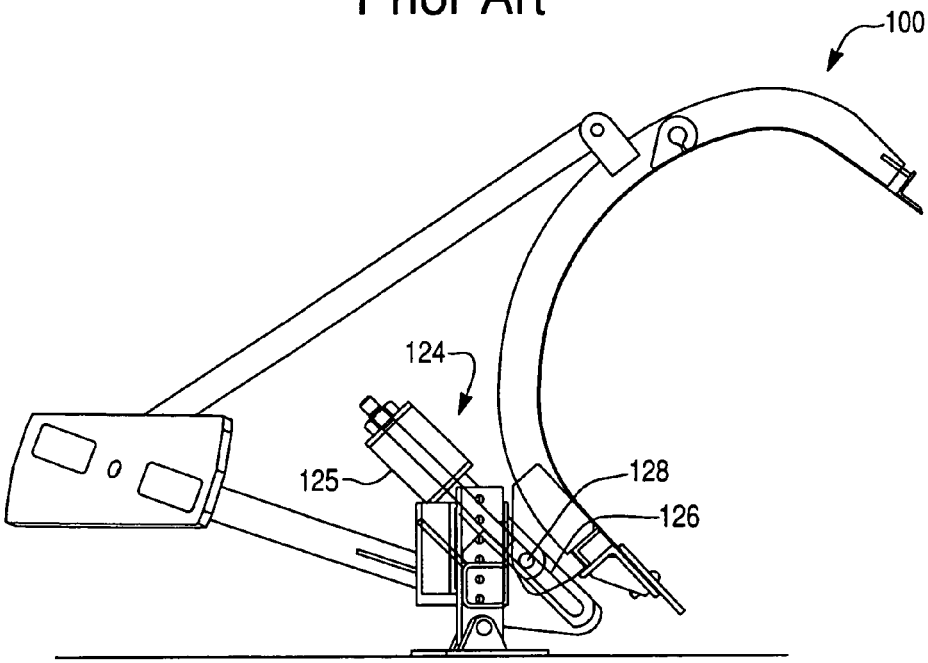
Fig. 2 Prior Art
FIG. 2 is a side view of a snow plow according to the prior art with the plow raised out of contact with the pavement.

With reference to FIG. 2, a trip mechanism 124 is provided for the moldboard 100 with the trip mechanism having a compression spring 125 which urges the lower portion of the moldboard against the pavement being plowed. The trip mechanism 124 includes a slot 126 through which a member 128 may slide to allow the moldboard to lift above the pavement upon striking an object. With reference to FIG. 2, the movement of the member 128 along the slot 126 moves a member 130 to compress the spring 125. After the moldboard has passed over the object, the moldboard is urged back against the pavement by the spring 125 which urges the member 128 downwardly along the slot 126.

Figure 3:
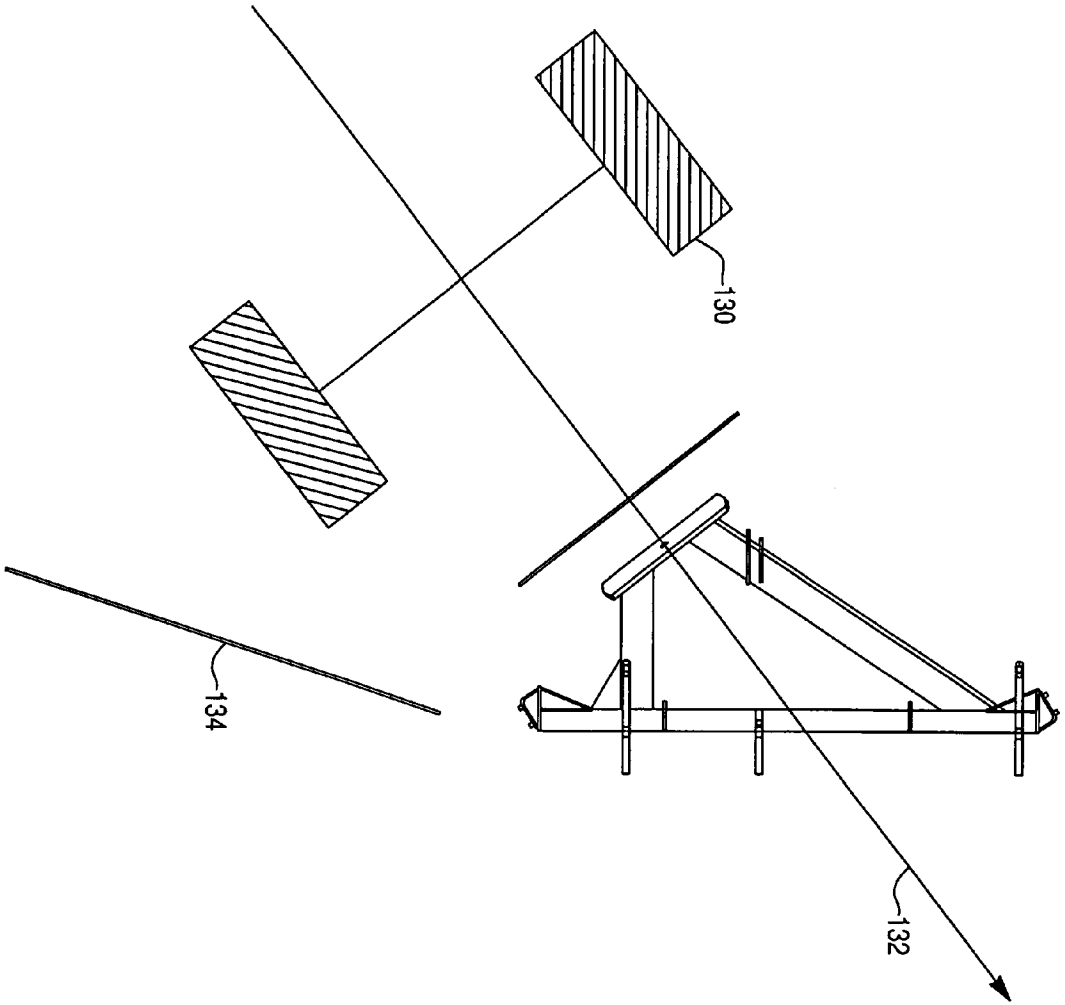
Fig. 3 Prior Art
FIG. 3 is a top schematic view of a snow plow that is angled with respect to a center line of a truck carrying the snow plow.

With reference now to FIG. 3, vehicle which carries the moldboard is illustrated schematically by the tires 130. The moldboard may be angled with respect to a center line 132 of the vehicle in order to divert snow and ice to one side of the vehicle. If desired, the moldboard (not shown) may be oriented perpendicular to the center line 132 or angled to the left or to the right of the centerline 132 of the vehicle. If desired, a wing plow 134 may be provided on one side of the vehicle to extend the width of the pavement being cleared by the vehicle in a single pass over the pavement.

Figure 4:
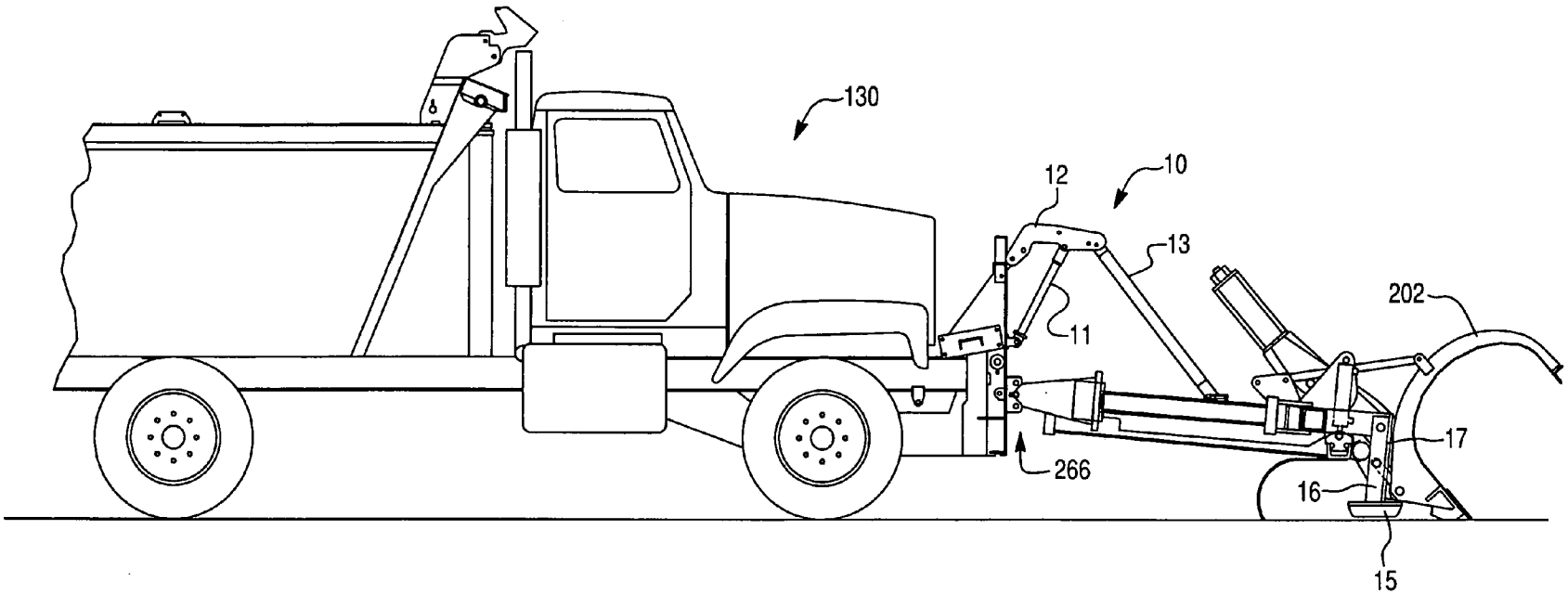
FIG. 4 is a side view of a first embodiment of a snow plow mounted to the front of a vehicle.

With reference to FIG. 4, a two stage snow plow 200 of a preferred embodiment of the invention has a primary moldboard 202 and a secondary plow 204 which is mounted to a drive frame 212 for pushing the moldboard 202. Plow 200 is shown attached to the front of a vehicle 130, secured to a bracket 266. A lifting mechanism 10 is mounted to the vehicle front end to lift and lower drive frame 212 and moldboard 202. Mechanism 10 includes a pivot arm 13 and lifting arm 12 that are controlled by a double action hydraulic cylinder 11. Moldboard 202 is of suitable conventional form and may be rigid or flexible, made from metal or from a non-metal material such as plastic, and it may also have a predetermined cross section or a cross section that can be changed to alter the ability of the moldboard 202 to divert snow and ice to one side of the vehicle. Moldboard 202 is coupled to drive frame 212 at a lower end to a trip mechanism 218 and at an upper end to a brace 206. Two vertically adjustable shoes 15 (only one shown in FIG. 4) are located on opposed sides of drive frame 212. Shoes 15 are connected to a bracket 16 that is mounted (by way of removable bolts) to an L-frame 17 which is connected at ends of a stiff, square tube 220 (FIG. 5) of drive frame 212. Shoes 15 are used to support drive 212 when moldboard 202 is raised off the pavement by the trip mechanism 218. Shoes 15 also protect secondary plow 204 so that the much heavier moldboard 202 does not cause damage to secondary plow 204 as moldboard 202 skips over obstacles encountered on a road surface.

Figure 5:
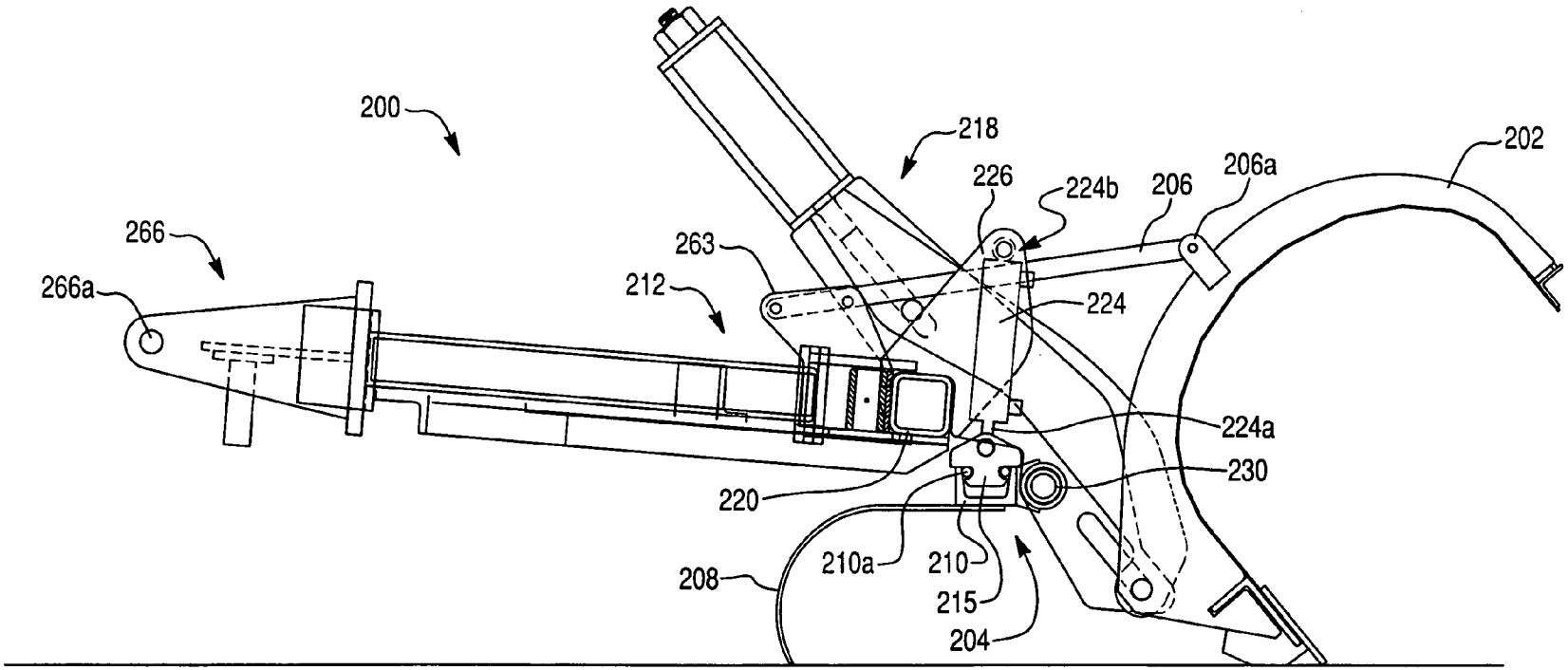
FIG. 5 is a side view of a portion of the snow plow of FIG. 4.
Figure 6:
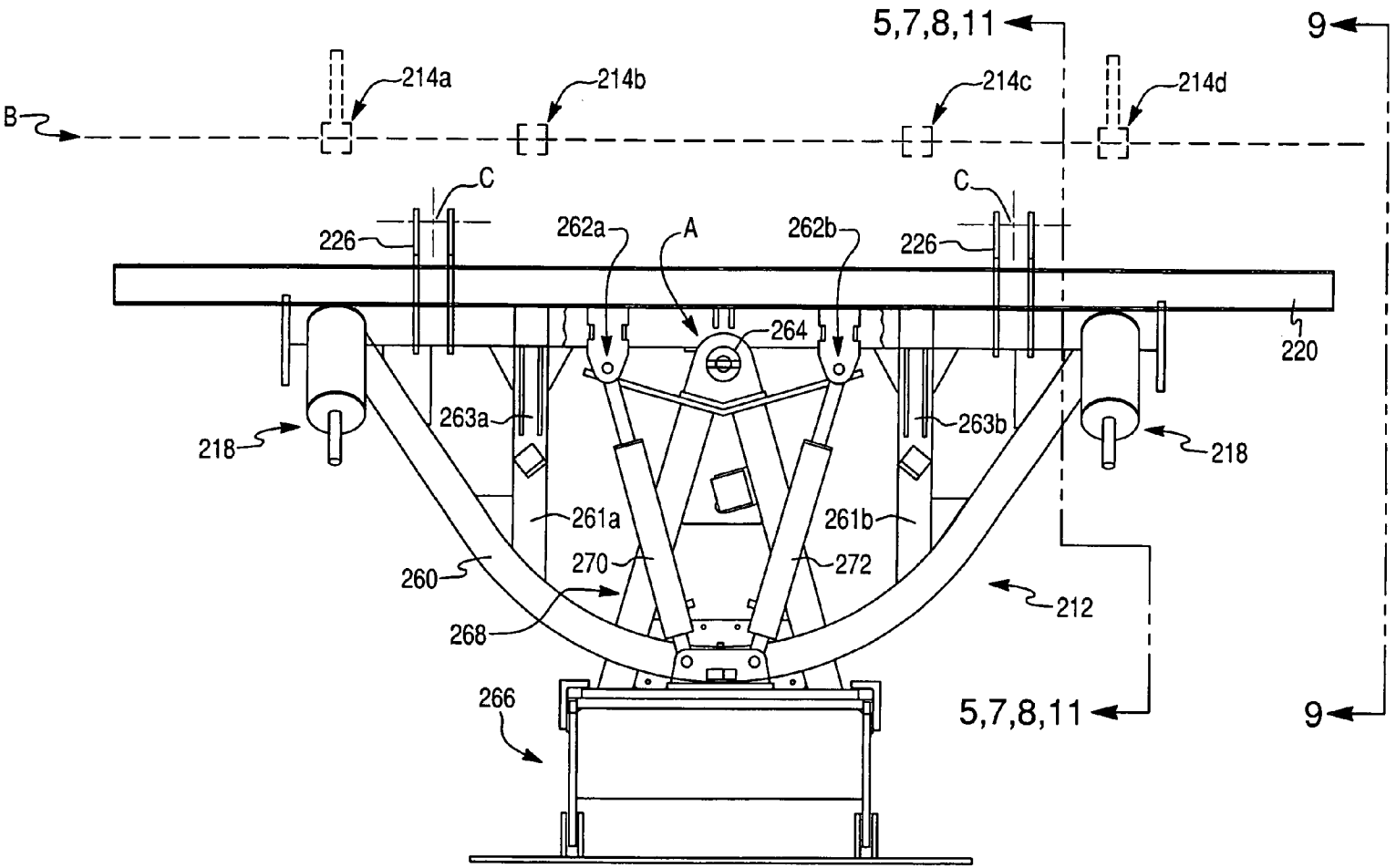
FIG. 6 is a top partial schematic view of a portion of the snow plow and vehicle of FIG. 4.

FIG. 5 illustrates plow 200 shown in FIG. 4, but with lifting mechanism 10 and shoes 15 removed for purposes of illustration, and FIG. 6 illustrates a top partial schematic view of plow 200. Referring to FIGS. 5-6, secondary plow 204 is mounted to drive frame 212, located directly behind moldboard 202, and operated independently of moldboard 202. Plow 204 is pivotally mounted to each of two supporting plates 236 of the plow's two trip mechanisms 218 and pivotally controllable by a pair of hydraulic cylinders 224 which pivot secondary plow 204 about an axis corresponding to the polar axis of a pivot tube 230 in FIG. 5, or axis B in FIG. 6. Plow 204 may also slide lengthwise over pivot tube 230, for purposes of repositioning plow 204 relative to moldboard 202 (as discussed in greater detail, below). A plurality of individual tines 208 are secured to and removable from a U-channel 210 of secondary plow 204 using, e.g., removable bolts (an angle iron, an I-beam, or round tube or other similarly suited supporting structure may be used in place of U-channel 210), extend along the length of U-channel member 210, and have substantially the same length as moldboard 202. Tines 208 form a scraping edge of the secondary plow 204 for purposes of removing residual snow left behind by moldboard 202. Tines 208 are discussed in greater detail, below.

Referring to FIG. 6, secondary plow 204 has four hinge points (shown schematically in FIG. 6 as 214*a*, 214*b*, 214*c* and 214*d*) that are located on the side of the U-channel member 210 that faces moldboard 202. These hinge points pivotally mount secondary plow 204 to drive frame 212. As indicated earlier, the rotation axis for secondary plow 204 is illustrated schematically in FIG. 6 by broken line B which corresponds to the polar axis of pivot tube 230 in FIG. 5, a tube which has a longitudinal extent approximately equal to the length of square tube 220. Two of the secondary plow 204 hinge mounts, namely, 214*a* and 214*d* are formed by sleeved holes in support plates 236 of trip mechanisms 218, one of which is illustrated in FIG. 7 as hole 236*a*, while the other hinge mounts 214*b*, 214*c* are formed on U-channel 210.

To position the outermost ends of secondary plow 204 within the path of moldboard 202 during snow plowing, pivot tube 230, which is mounted and secured with two lock nuts and bolts to U-channel 210, is arranged to slide either to the right or to the left over bearing surfaces provided by the holes formed in support plates 236 as moldboard 202 is angled to discharge snow to the right or to the left, respectively, of the plowing vehicle. Separate bearing sleeves are preferably installed in holes 236*a* to facilitate sliding motion of secondary plow 204. The sliding feature of secondary plow 204 is described in greater detail, below and illustrated in FIG. 11.

Figure 11:
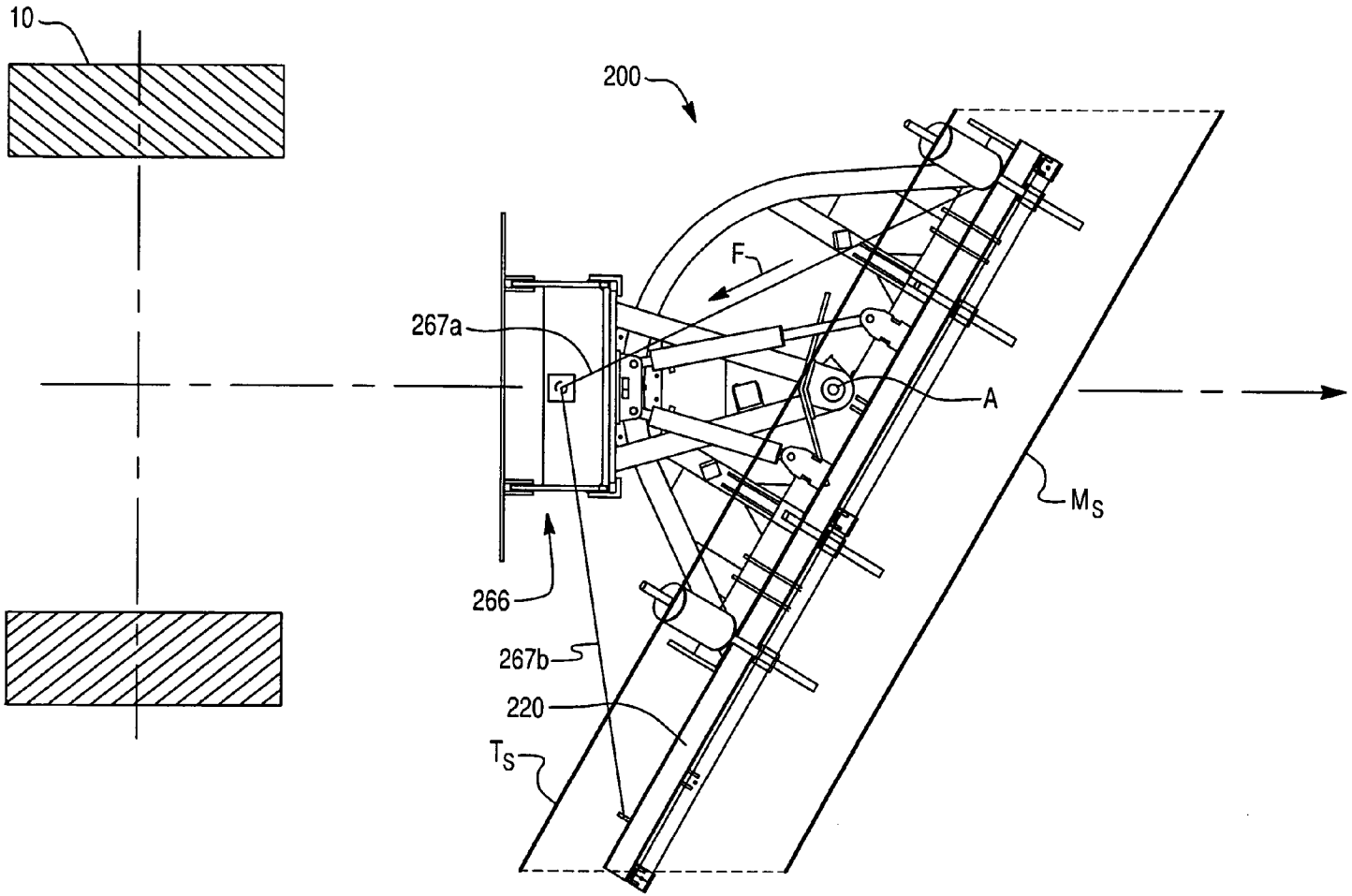
FIG. 11 is a partial schematic top view of the vehicle and snow plow of FIG. 4, but with the snow plow rotated about an axis A so as to divert snow to the right of the vehicle and the secondary plow positioned completely behind the plowing path of the moldboard.

Drive frame 212 is coupled to bracket 266 by an A-frame 268. A pair of hydraulic cylinders 270, 272 (not shown in FIG. 5) are used to rotate drive frame 212 about a rotation axis A so that moldboard 202 may be angled to divert snow left or right of the vehicle path, as illustrated in FIG. 11. Drive frame 212 includes an arcuate member 260 and truss members 261*a*, 261*b*, which provide structural support for drive frame 212 and mount flanges 263*a*, 263*b*, respectively, which are used with braces 206 to pivotally support moldboard 202 at an upper end thereof. Hydraulic cylinders may also be used in place of braces 206. A-frame 268 is pivotally coupled to drive frame 212 at hinge 264 located centrally on square tube 220, while actuating ends of hydraulic cylinders 270, 272 respectively are pivotally connected at locations 262*a*, 262*b* respectively. Synchronous actuation of hydraulic cylinders 270, 272 effect rotation of drive frame and thus plow 204 and moldboard 202 about rotation axis A.

Figure 7:
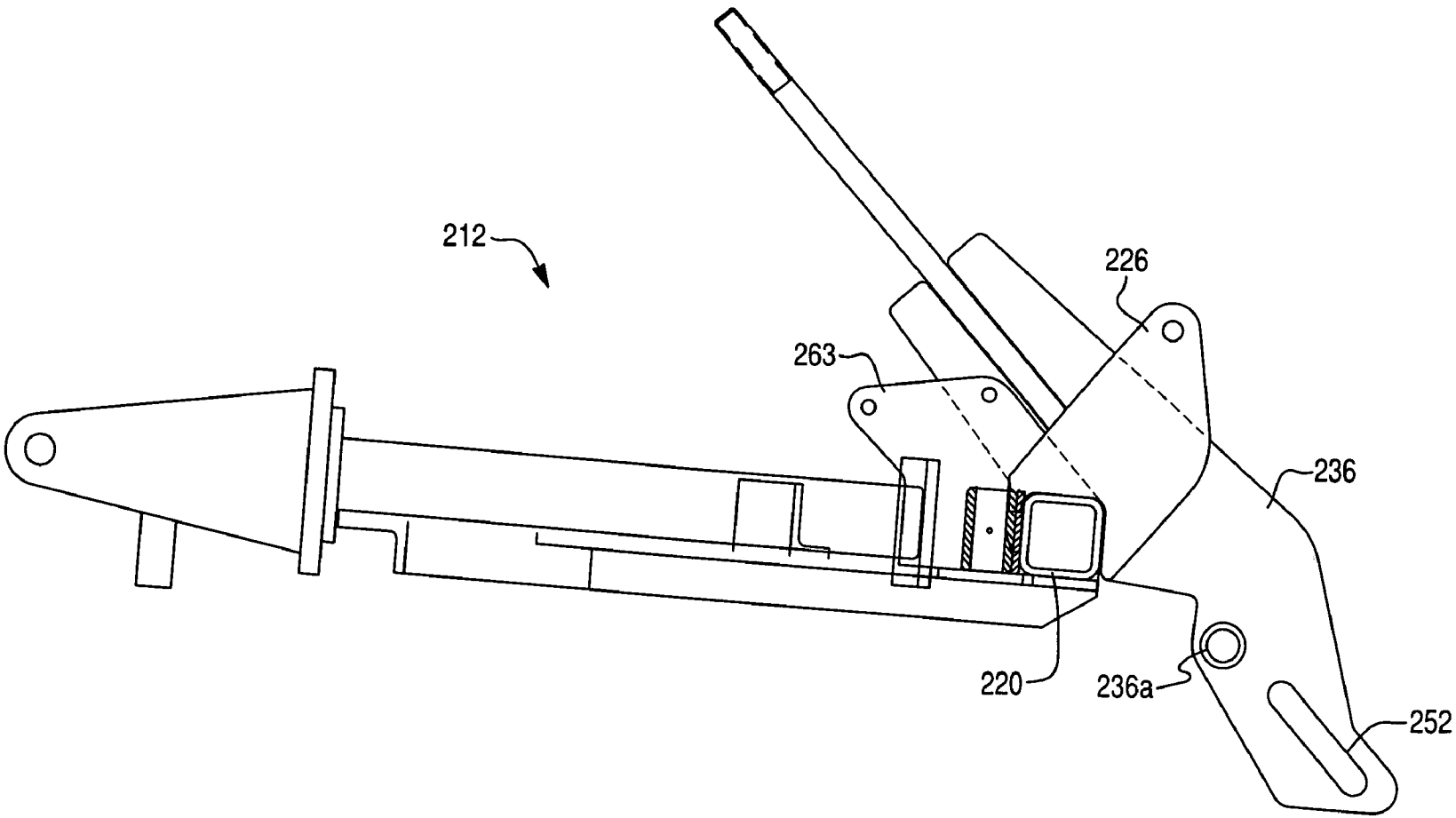
FIG. 7 is a side view of a portion of the snow plow of FIG. 5.

FIG. 7 illustrates structure mounted on drive frame 212 and associated with moldboard 202 and secondary plow 204. This structure is also shown in FIG. 5 with secondary plow 204 and moldboard 202. Square tube 220 supports a pair of trip mechanism support plates 236 having lower slots 252 that receive a pins (not shown) coupling moldboard 202 to drive frame 212, as discussed below, and flanges 263 for braces 206. A hole 236*a* is formed in plate 236 to allow tube 230 to pass through and be supported by support plate 236. As indicated earlier, tube 230 may also slide within hole 236*a*. Drive frame 212 also includes a pair of flanges 226 for mounting hydraulic cylinders 224 for secondary plow 204, as discussed in greater detail below.

Figure 9:
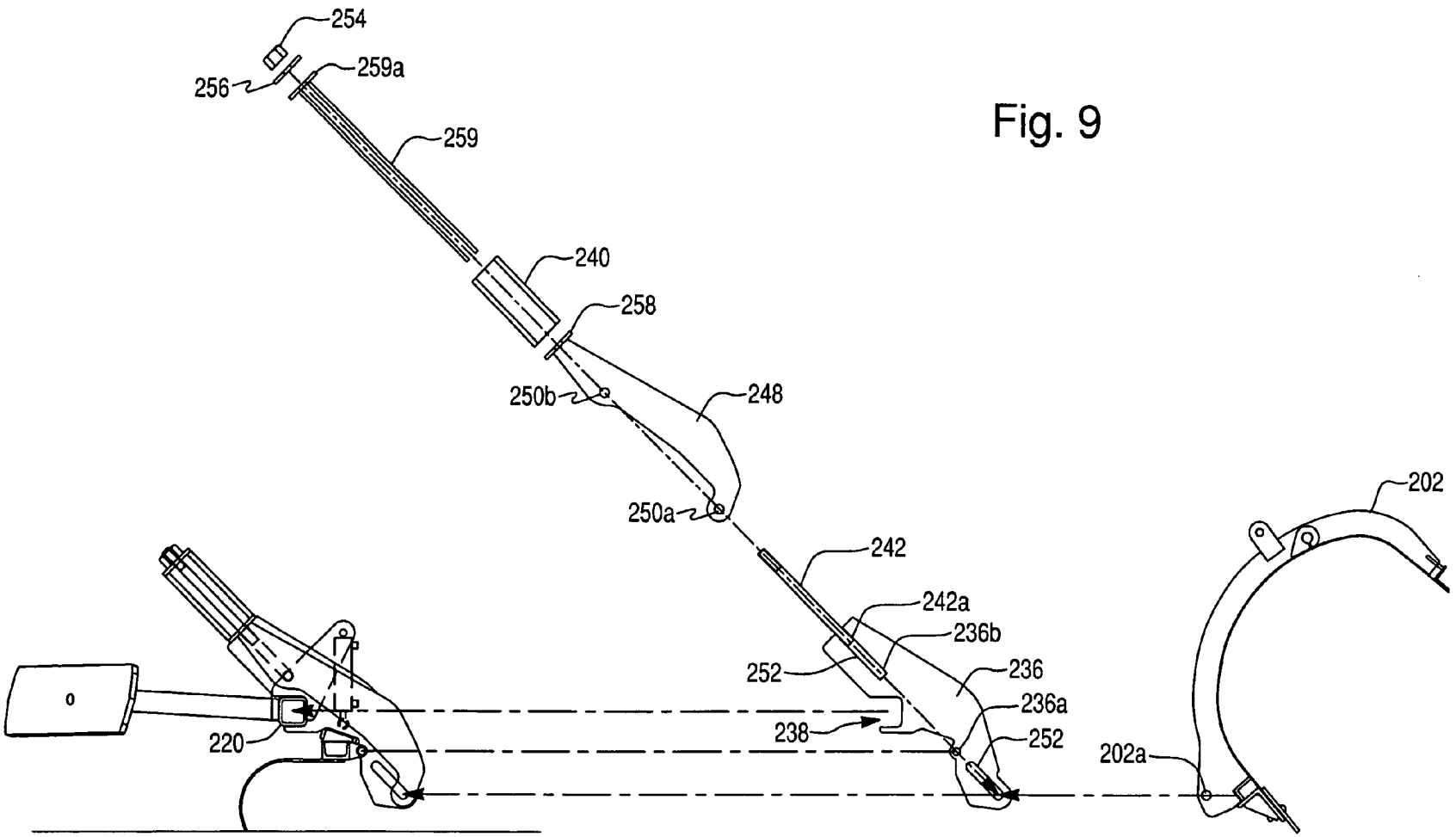
FIG. 9 is a partial exploded side view of the snow plow of FIG. 5 illustrating an assembly of a trip mechanism.

With reference to FIG. 9, which shows a partially exploded view of plow 200, the attachment of moldboard 202 to drive frame 212, by way of trip mechanism 218, will now be described. As mentioned earlier, drive frame 212 mounts a trip mechanism support plate 236 at square tube 220 (recess 238 is mated with tube 220). A rod 242 is fixed at its lowermost end 242*a* to an upper portion 236*b* of support plate 236. A sleeve 259 is placed over rod 242. A flange 259 of sleeve abuts a washer 256 and rod 242 is secured to nut 256. A trip helper plate 248 is provided with lower and upper pins 250*a*, 250*b* which are arranged to slide within corresponding slots 252 of support plate 236. Lower pin 250*a* is also pivotally connected to a lower portion of moldboard 202 by pin 250*a* being simultaneously received in a hole 202*a* of moldboard 202 and slot 252 of support plate 236. The upper end of helper plate 248 has a flange 258 that engages the lower end of spring 240, so that spring 240 is compressed between flanges 258 and 259*a* when helper plate 248 is pushed upwards by moldboard 202. Accordingly, the trip support plate 236, fixed to drive frame 212, is arranged to allow upwards and rearwards movement of support plate 248 along slots 252 against the force of compression spring 240, which lifts the scraping edge of moldboard 202 off of the ground. When the moldboard 202 encounters an obstacle, helper plate 248 and therefore moldboard 202 are urged upward and over the obstacle. After the moldboard 202 has passed over the obstacle, the compression spring urges the trip helper plate 248 and therefore the moldboard 202 downwardly until the moldboard again encounters the pavement. Shoes 215 (FIG. 4) are used to stabilize plow 200 and protect secondary plow 204 when moldboard 202 is pushed off the ground by an obstacle.

With reference again to FIG. 6, rotation of secondary plow 204 about drive frame 212 (axis B in FIG. 6, bar 230 in FIG. 5) is controlled by a pair of hydraulic cylinders 224. Each hydraulic cylinder 224 is identical to that illustrated in FIG. 5. The line of action for both these hydraulic cylinders is illustrated schematically in FIG. 6 by C. Hydraulic cylinders 224 are coupled to U-channel 210 by way of a box 215 formed by two opposed plates (FIG. 5 shows one of these plates) that mount a rod attaching actuating end 224*a* of hydraulic cylinder 224 to secondary plow 204, specifically, U-channel 210. Flange 226 mounts the housing end 224*b* of hydraulic cylinder 224. The box 215 for actuating end 224*a* of hydraulic cylinder 224 has two half-round grooves that receive two rods 210*a* which are welded to the inner surfaces of U-channel 210. When secondary plow 204 translates as illustrated in FIG. 11, the box 215 slides along rods 210*a*. At the same time, secondary plow 204 is supported by way of the coupling between box 215 and U-channel 210 when secondary plow 204 is raised and lowered by hydraulic cylinder 224.

Figure 8:
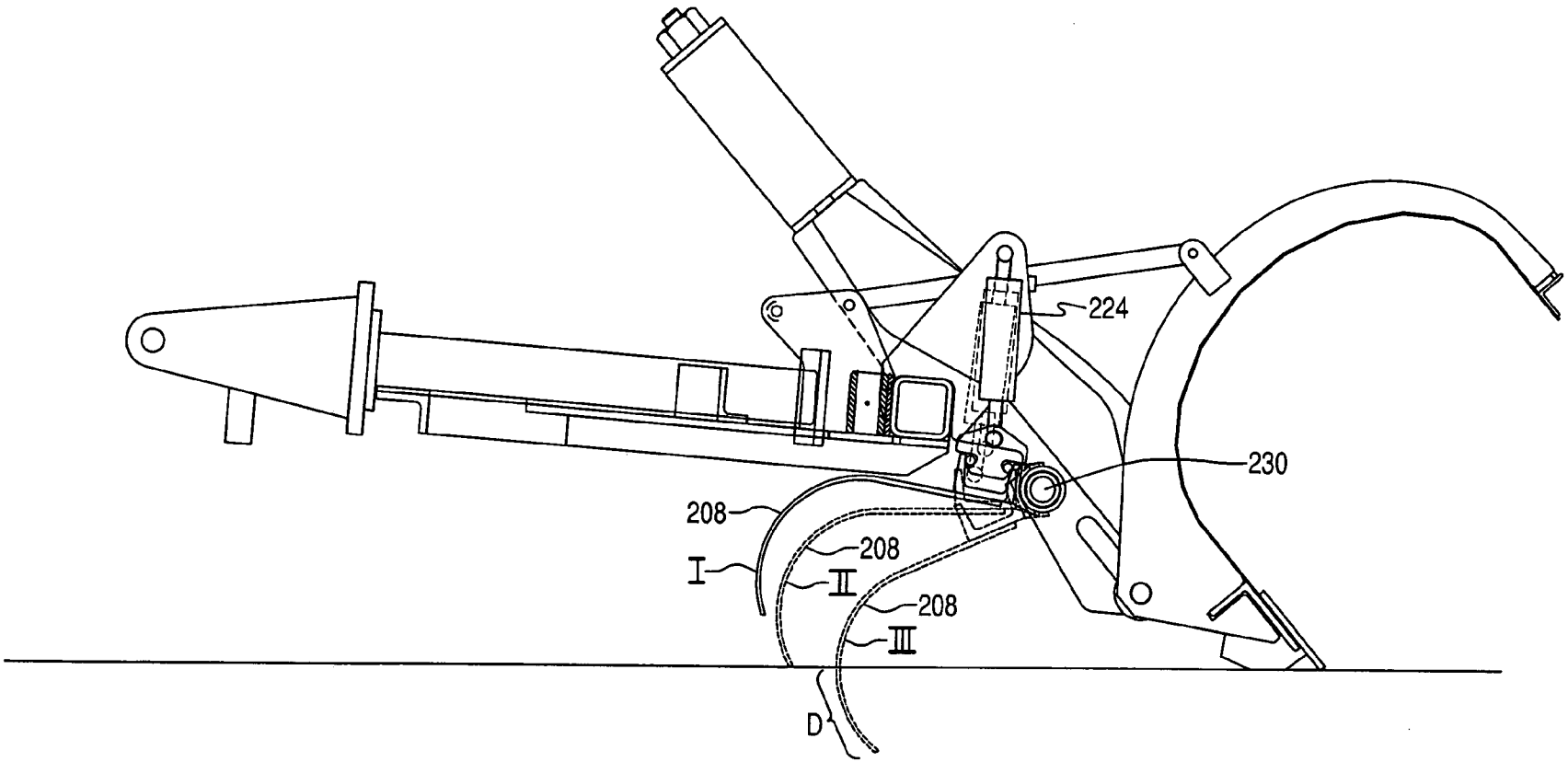
FIG. 8 is a side view of the snow plow of FIG. 5 showing three angular positions of a secondary plow.

Referring to FIGS. 6 and 8, hydraulic cylinder 224 raises and lowers secondary plow 204 by applying a force at position C, which causes secondary plow 204 to rotate about bar 230 (rotation axis B). Hydraulic cylinder 224 may be used to raise tines 208 from (position I) or lower tines 208 to (position II) the plowing surface. Additionally, hydraulic cylinder 224 may be operated to rotate tines 208 to a position III, which would be needed to bring tines 208 into contact with the ground after the lower portion of tines 208 (indicated by D) has eroded. Thus, even when the tines 208 have undergone a significant amount of erosion, tines 208 may still be used by further extending hydraulic cylinder 224 so that an appropriate pressure may be applied to tines 204.

Hydraulic cylinders 224 provide an appropriate and steady pressure for tines 208 to scrape the residual snow/ice from the road. Further, hydraulic cylinders 224 provide the steady pressure regardless of and compensating for, the wear that takes place at a scraping edge of the tines 208 or fingers while they are plowing. The appropriate pressure provided by the hydraulic cylinders to urge the tines 208 against the pavement is dependent on the condition of snow (i.e., lightly packed to highly packed snow) on the road. The pressure can be set as well as monitored accurately at a gauge installed in a cab of the vehicle, throughout the plowing operation. See FIG. 20 and related discussion, infra.

If the pressure urging the tines 208 downwardly is unnecessarily high, the tines 208 may be subjected to undue wear at a scraping edge. Unnecessarily high pressure may also cause damage to the pavement. However, inadequate pressure at the tine tips may be ineffective for removing packed snow and ice from the pavement. Because the drive frame 212 is supported by plow shoes 15, FIG. 4, the amount of downward pressure provided by the two hydraulic cylinders is independent of the weight of moldboard 202.

In the preferred embodiment, tines 208 are urged downward by hydraulic cylinders. Springs may be used, however, it is preferred to use controllable hydraulic cylinders because it may be difficult for one or more springs to provide a relatively constant amount of downward pressure on the tines 208, especially by one or more coil springs. Further, the coil springs may not deliver a relatively constant pressure at the tips of the tines or fingers because of the shortening of the tines at the ends or tips as the tines start to wear during a plowing operation.

If the tines 208 were urged downwardly by coil springs, the downwardly directed pressure exerted by the coil springs may not be easily compensated for as the fingers 208 wear. Therefore, the downwardly directed pressure exerted by the coil spring will tend to decrease as the tines erode and get shorter and shorter. In order to scrape the snow and ice from the road efficiently, in the preferred embodiments an appropriate and steady downwardly directed pressure is applied by the tips of the fingers or tines against the pavement during the entire plowing operation. Of course, an arrangement, not shown, could readily be provided for adjusting (either automatically or manually) the downward force applied by one or more coil springs to the tips of the tines against the pavement.

Sliding Feature

Figure 10:
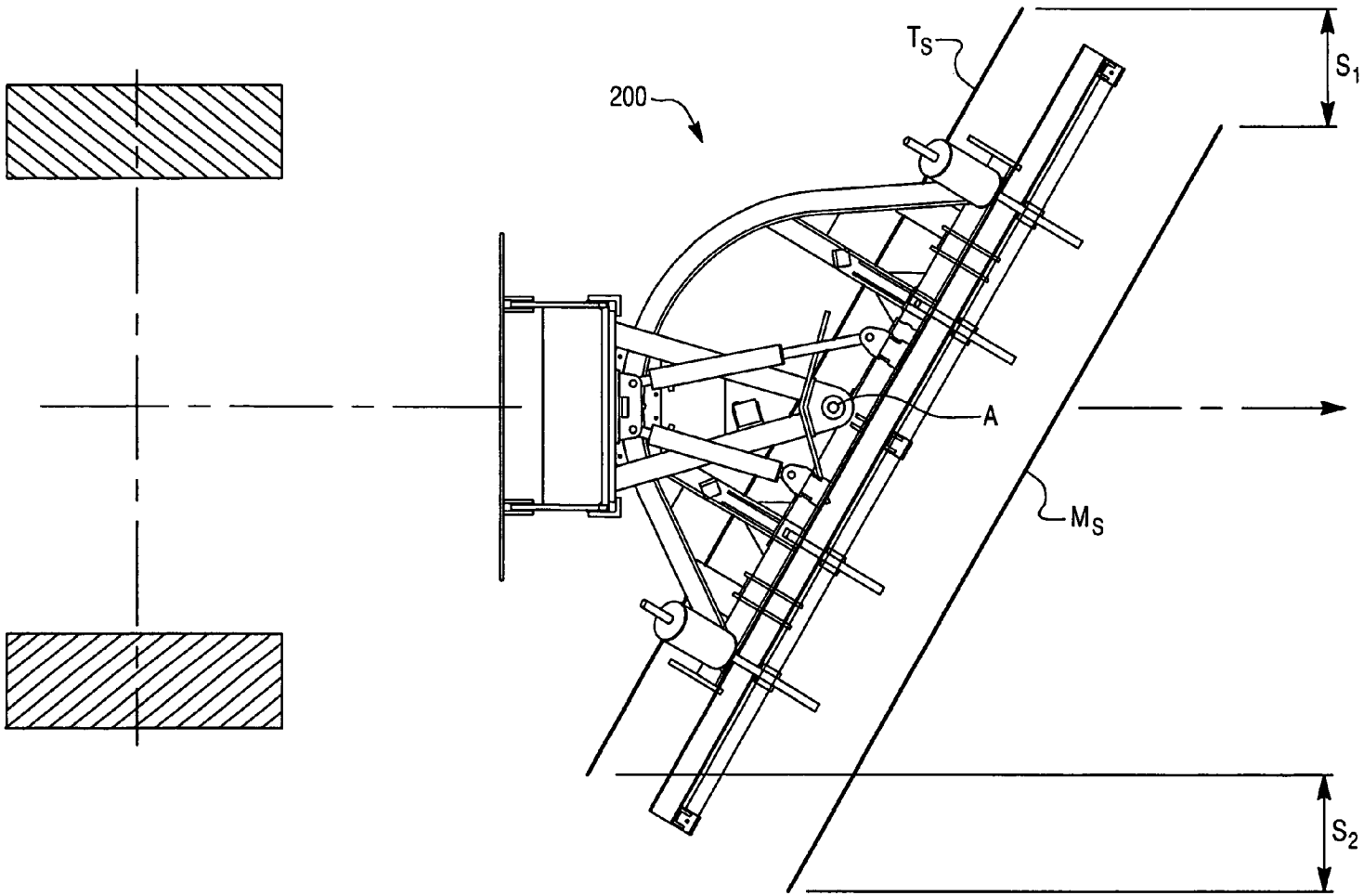
FIG. 10 is a partial schematic top view of the vehicle and snow plow of FIG. 4, but with the snow plow rotated about an axis A so as to divert snow to the right of the vehicle and without the secondary plow positioned completely behind the plowing path of a moldboard.

FIGS. 10-11 are top view illustrations of plow 200 without tines 208 of secondary plow 204 or moldboard 202 shown. Instead, secondary plow 204 and moldboard 202 are represented by their respective scrapping edges $T_S$ and $M_S$, i.e., edges that come into contact with the ground. Plow 200 is located at the front of a vehicle (the vehicle orientation is indicated by the tire silhouettes 10) with the vehicle path being left to right and the drive frame 212 rotated approximately 30 degrees so as to divert snow right of the vehicle. FIG. 10 illustrates the position of tine edge $T_S$ relative to moldboard edge $M_S$ if secondary plow 204 were fixed relative to drive frame 212. As shown, an upper portion of edge $T_S$ encounters a section of snow $S_S$ that is not first met by a corresponding upper portion of edge $M_S$ while a lower portion of edge $T_S$ does not cover a section of snow $S_2$ that is encountered by a corresponding lower portion of edge $M_S$. FIG. 11 illustrates the positioning of edge $T_S$ relative to edge $M_S$ if secondary plow 204 is free to slide relative to drive frame 212 and coupled to linkages 267*a*, 267*b*. By comparison with FIG. 9, it is seen that edge $T_S$ covers the same path of snow first encountered by edge $M_S$. Thus, by repositioning secondary plow 204 behind moldboard 202 along its entire edge, all areas of the roadway encountered by edge $M_S$ are also covered by edge $T_S$. Edge $T_S$ is repositioned relative to edge $M_S$ in FIG. 11 by a force F applied to secondary plow 204 by linkage 267*a*, which is under tension. The force applied by linkage 267*a* pulls upon secondary plow 204, causing it to slide along its track, toward the lower end of square tube 220. If drive frame 212 were rotated counterclockwise, then linkage 267*b* would come under tension and pull secondary plow 204 towards the upper end of square tube 220. This behavior is evident when considering that linkages 267*a*, 267*b* have a fixed length and thus, when drive frame 212 rotates, one end of drive frame 212 is brought closer to the location where both linkages 267 are fixed, while the other end is further away, causing the connecting linkage to go under tension (thereby pulling secondary plow towards it). Accordingly, in an embodiment of the invention, when the plow is positioned to plow snow, the moldboard 202 is rotated and the secondary plow 204 is rotated and translated along a direction parallel to a scraping edge of the moldboard 202. Additionally, as discussed above and below, secondary plow 204 may also be operated independently of moldboard 202.

A variety of mechanisms may be employed as alternatives to the first embodiment for translating secondary plow 204 when drive frame 212 rotates into a plowing position. For a example, three interlocking gears (two rotary and one linear) may be used. One rotary gear would mount to the drive frame 212, e.g., at axis A, and would engage a second rotary gear, which could be mounted to the A-frame 268. This pair of gears would have a greater than 1:1 gear ratio. The second gear would then engage with a linear gear on secondary plow 204, e.g., a rear surface of U-channel 210 would have gear teeth adapted for engaging the second rotary gear. When drive frame is rotated, the second gear rotation would cause the U-channel 210, and therefore tines 208, to translate parallel to the moldboard 202 scrapping edge.

In preferred embodiments, two sections of steel chain are used to pull secondary plow 204 over the bearing surfaces defined by holes 236*a* and towards one or the other end of square tube 220 of drive frame 212. One end of each chain is attached to two lugs, each of which is welded to two ends of a rear flange of U-channel 220 (not shown in FIG. 6 but illustrated schematically in FIG. 11). The rear flange faces rearwardly toward the truck. The other end of each chain is attached to a common sleeve 266*a* with lugs that swivel within a vertical short shaft that is welded to a bottom face of a stiffener plate of the swivel hitch.

Tines 208

As mentioned earlier, tines 208 form a scraping edge of the secondary plow 204 for purposes of removing residual snow left behind by the primary moldboard 202 while it is plowing.

Figure 15:
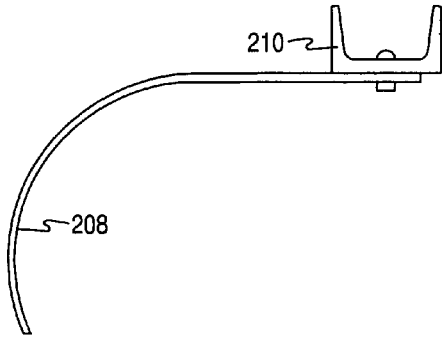
FIGS. 15 and 16 are respective side and front views of a portion of the secondary plow according to the first embodiment.
Figure 17:
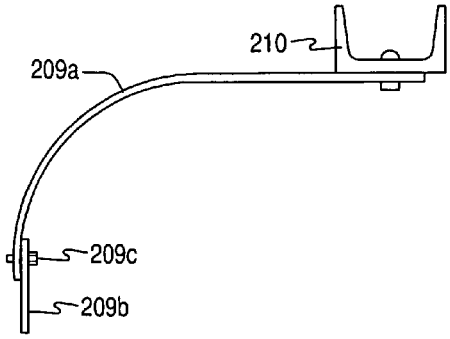
FIG. 17 is a side view of an alternative embodiment of a portion of the secondary plow according to the first embodiment.
Figure 16:
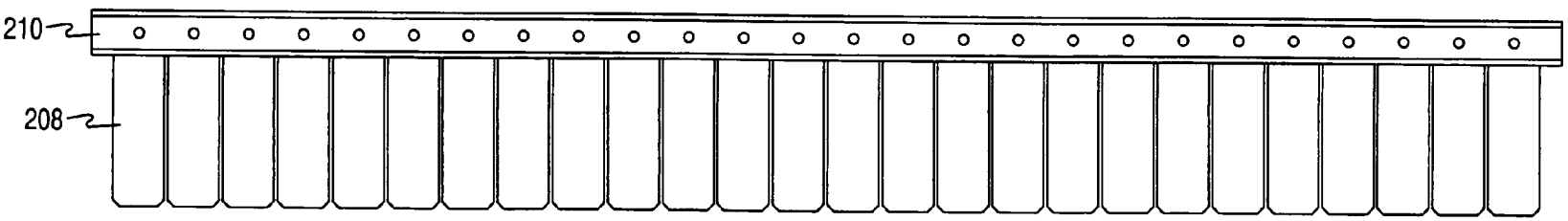

Referring to FIGS. 15-16, each have a first portion that is curved, preferably substantially semi-circular in shape, and a second portion that is generally straight. They are made from flat spring steel, preferably one-piece, and are readily available for replacement as suitable tines are often used for agricultural applications. When plow 204 is mounted to drive frame 212, tines 208 will extend in a concave manner towards the main moldboard 202. Tines 208 may be one-piece. However, upon conducting a series of road tests, it was found that tines 208, when formed from spring steel, can erode at an undesirable rate. A two piece tine was therefore employed. In this design, tines 208 have a first part made of spring steel and a tip made of carbide that is bolted to the first part. The carbide tip may form a portion of the curved section of tine 208 illustrated in FIGS. 15-16 or a straight part secured at the distal end of a tine. FIG. 17 illustrates one example of a secondary plow with tines that include a carbide tip. Tine 209*a* has an end in which a carbide scraping tip 209*b* is secured thereto by a releasable fastener 209*c*.

In the preferred embodiments, the spacing between adjacent tines is preferably about 0.016 inch. In the preferred embodiments, the tines do not overlap one another because overlapped tines or fingers are unduly rigid because each tine or finger effectively becomes an integral part of effectively a single blade extending along the length of the U-channel member. Accordingly, overlapped tines or fingers are effectively prevented from individually following the contour of the road or pavement and the scraping ability of the tines is relatively poor and inefficient. On the contrary, when the fingers or tines are not overlapped, the fingers are flexible and able to oscillate especially when they are made of spring steel.

Oscillating fingers are considered to be especially desirable for scraping bonded snow and ice because the oscillating fingers provides an impact force against the packed snow and ice when they oscillate (move back and then forth) during the plowing operation.

With reference to FIGS. 15-16, in one configuration for the individual tines 208, the concave portion of the tines or fingers are substantially semi-circular with two substantially tangential straight top and bottom end portions. The bottom straight end portion of the tines together essentially functions as the blade of a plow even though the individual tines are spaced apart from one another. The top straight portion, made of spring steel, is fastened to U-channel 210. The bottom straight portion, i.e., the portion in contact with pavement, is made from carbide or another sufficiently hard material. The inside surface of the arrangement of tines or fingers formed by the lower relatively flat lower portion and the curved semi-circular portion may be made relatively smooth to essentially provide a continuous surface for facilitating efficient snow and ice flow along the plurality of tines or fingers.

The inside surface and contour of the arrangement of tines or fingers corresponds closely to the inside surface and contour of a conventional plow or moldboard. In this way, secondary plow 204 may be used as a small-scale reversible plow. The tines or fingers 208 face toward the front of the vehicle (i.e., in the plowing direction) as does the moldboard 202. In the preferred embodiment, a space adequate to accommodate at least about 80% of the residual snow left behind by the main plow, is provided between the rear of the moldboard 202 and the front of the secondary plow 204 beneath the drive frame 212 so that the snow and ice left by the moldboard 202 and scraped by the secondary plow 204 can flow without interruption along the inside curvature of the secondary plow 204 and be discharged from one end of the secondary plow 204, substantially as in a curved moldboard of a typical snow plow.

An obstacle or shield provided in front of secondary plow 204 would narrow down the space needed between plow 204 and moldboard 202 and tend to prevent scraped snow and ice from flowing. As a result, secondary plow 204 may clog. In a preferred embodiment, secondary plow 204, the uppermost portion of the individual tines or fingers are not inclined with respect to the plowing direction because such an incline would tend to pack the snow and thereby clog the flow of snow and ice along the inside surface of plow 204.

Because secondary plow 204 operates independently of moldboard 202, it is not necessary that plow 204 be used every time moldboard 202 is used for snow removal. Instead, the operator may decide based on conditions. For example, plow 204 may not be needed if the snow is not packed to the ground and plowing with moldboard 202 is deemed sufficient to keep the road open and safe. Additionally, it may not be necessary to use secondary plow 204 when residual unpacked snow is left behind by moldboard 202 if the road that has been treated with anti-icing treatment before a snowstorm and warm weather is expected. In this situation, most or all of the residual snow will be melted by the anti-icing treatment and the warming weather. By selective use of secondary plow 204, the life of the individual tines or fingers can be extended.

When cold weather is forecasted to continue or worsen after plowing, when another snowstorm is expected, or when anti-icing treatment would need to be reapplied, it is desirable to remove most or all of the residual snow (whether packed, unpacked or slushy). Removing this residual snow and ice prevents an excessive dilution of the anti-icing chemicals which makes the chemicals ineffective to prevent the packed snow or ice from developing a bond with the pavement. In a situation such as this, use of secondary plow 204, either with tines or a resilient blade (discussed infra) would be helpful.

Anti-icing chemicals are applied to pavement, typically before a winter storm to prevent bonding between snow or ice and the pavement. The anti-icing chemicals depress the freezing point of water. If the snow or ice is not bonded to the pavement, plowing of the un-bonded snow and ice is relatively effortless. Accordingly, the use of anti-icing chemicals is well suited to roads that have a relatively high level of traffic and is considered to be relatively cost effective.

De-icing of pavement is considered to be a highway snow and ice control operation. The typical, traditional procedure of snow and ice control practice is to wait until an inch or more of snow accumulates on the pavement before beginning to plow and to treat (de-ice) the highway with chemical abrasives and then plow away the slushy snow. The amount of residual packed or unpacked snow and ice that typically remains on the road (after the application of the conventional anti-icing chemicals) is generally considered to be high. Therefore to keep the road open and safe, the amount of de-icing material needed to penetrate the pavement is relatively high and considered to be expensive.

Secondary plow 204, when used in conjunction with moldboard 202, reduces the amount of residual snow and ice left on the pavement after plowing. Therefore, the amount of de-icing chemicals can be reduced and the time taken for chemicals to reach the pavement (by melting through the ice and snow) is reduced. A reduction in the use of anti-icing chemicals is usually considered beneficial to the environment.

Secondary plow 204 facilitates the reduction of anti-icing chemicals, such as sodium chloride, calcium chloride, magnesium chloride and salt etc., required by anti-icing and de-icing treatments of roads in order to keep them open and safe in the winter storm. Tines 208 remove a layer of snow from the pavement that is left behind by the moldboard 202. In addition, tines 208 help break apart frozen snow on the pavement being plowed into tiny pieces so that chemicals may more quickly penetrate through the snow. In this way, the amount of time needed to melt any remaining snow on the pavement is shortened and the amount of chemicals that are needed to treat the road is reduced.

With reference to FIGS. 8 and 15-16, preferably, the angle that tines 208 make with the pavement, almost vertical (about 75 to 90 degrees), is desirable with 85 to 90 degrees preferred, and close to 90 degrees is most preferred. Close to vertical is more effective and good for scraping. Tines 208 are preferably inclined more than 45 or 50 degrees (like a plow blade) because a more shallow angle typically cannot take hard pack off. Instead, the tines tend to slide over hard packed snow. Tines 208 may be formed from one-piece metal with slots up to four inches from the securing bolts but it is preferred to have industrial tines which better follow the contour of the road. The tips of tines may be square (commercially available ones have a notch) and of the type used for cultivators, as are available from John Deere (a support spring from a tooth cultivator). Preferably, tines are two-piece, with tips made of carbide.

When the secondary plow uses tines 208, about 70% or more of the residual snow and ice left on the pavement by the primary moldboard 202 is reduced and therefore the amount of the chemical needed to clean the road from a snowstorm is reduced. Additionally, secondary plow 204 reduces the time required for chemicals to penetrate through to the pavement and melt the remaining snow left by secondary plow 204 (typically less than about 30% of the residual snow of the primary moldboard). Thus, delays caused by snowstorms are significantly reduced.

In one embodiment of secondary plow 204, ninety-six tines are arranged vertically, with a 1/16 inch gap provided between adjacent tines. Tines are composed of a flat spring bar which is 1 inch×5/16 inch thick and shaped to an overall height of 13 inches with a depth of 16 inches. The top horizontal arm is 7 inches long and the bottom vertical arm is 6 inches long with the curved section having a radius of 6 inches. In another embodiment, the bottom vertical arm may be made of carbide or another relatively hard material.

In one embodiment, tines were set at an angle of 37 degrees with respect to the forward direction of the vehicle and the hydraulic cylinders 224 provided a downward force of about 3500 lbs. to about 4000 lbs. on the tines 208 to scrape the packed snow from the road. This arrangement produced satisfactory results.

Secondary Plow 304

Figure 12:
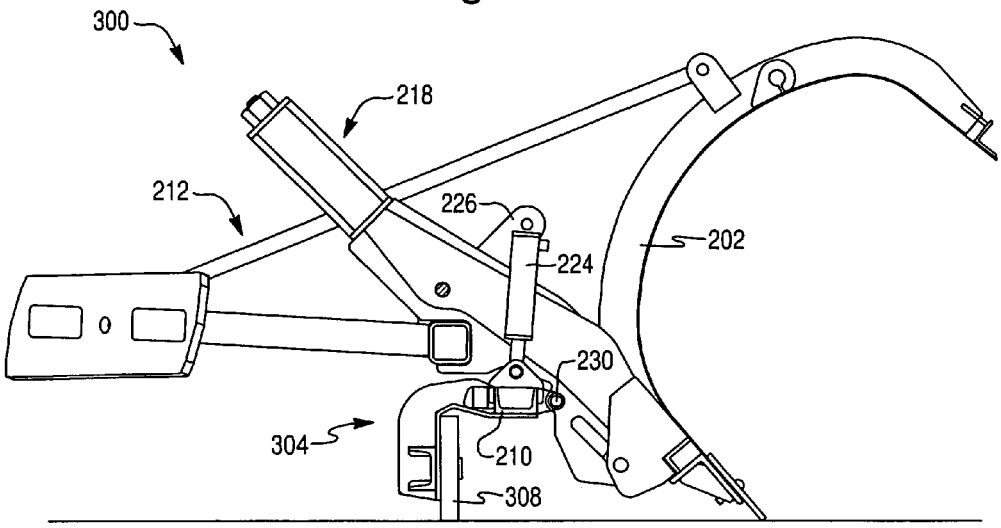
FIG. 12 is a side view of a second embodiment of a snow plow.
Figure 13:
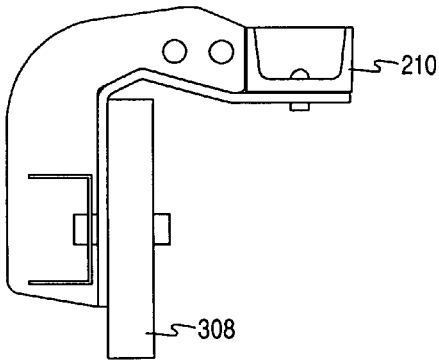
FIGS. 13 and 14 are respective side and front views of a portion of a secondary plow of FIG. 12.
Figure 14:
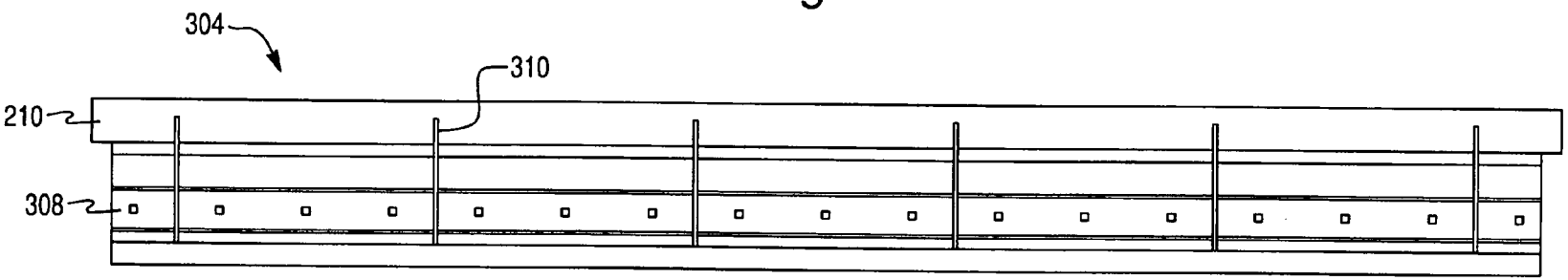

A second embodiment of a secondary plow, plow 304, is illustrated in FIGS. 12-14 and described below. Drive frame, moldboard and other structure associated with the use of plow 304, was sufficiently described in connection with the first embodiment above in order to fully appreciate much of the attributes and construction of a plow incorporating plow 304. Reference will therefore be limited in discussing secondary plow 304. Plow 300 engages the ground with a resilient blade 308, preferably rubber that is impregnated with vertical steel cable. The mounting arrangement is essentially the same as in secondary plow 204. Plow 304 may be employed with or without the primary moldboard 202 as it is especially suitable for snow removal in large cities where snow usually does not accumulate excessively or develop a bond to the pavement.

Resilient blade 308 may be used when the pavement has been treated with solid chemicals and/or with liquid chemicals (typically after one inch or more of snow has accumulated on the pavement). Plow 300 is used to plow away the slushy snow and reduce or minimize the ability of the slushy snow from re-freezing into ice. Plow 300 is also beneficial, especially in relatively congested areas and heavily traveled streets and roads such as in the center of cities, where snow typically does not bond to the pavement road but instead remains slushy due to dense traffic. Plow 300 is also especially useful to prevent an excessive dilution of anti-icing chemicals by residual slushy snow remaining on the pavement before an anti-icing treatment of the road is to be provided (such as before a snowstorm is expected).

As illustrated in the drawings, blade 308 is mounted to a series of supporting plates 310 which are connected to drive train 212. Hydraulic cylinders 224 may be used to raise or lower blade 308 and may selectively apply pressure to blade 308 when it engages the road surface. Plow 300 may be mounted with or without secondary plow 204. Additionally, as both of these secondary plows may have a common mounting device, either may be interchangeably mounted with moldboard 202. In other embodiments, conventional plows may be modified to mount a secondary plow controlled by a hydraulic cylinders, where the secondary plow may use one or both of tines and a resilient blade. As in the previously described embodiments, the blade types may be used separately or together, and the plow may be configured to readily to switch one for the other as needed.

Secondary Plow 404

To mount the secondary plow 204 on an existing, conventional plow, the frame between the swivel plate at the back and the square tube, e.g., tube 120 in FIG. 1, for mounting the plow at the front may require modification to accommodate a secondary plow 204 behind moldboard 202. The space that is available under the drive frame to accommodate secondary plow 204 may be limited and may not permit the discharge end of secondary plow 204 to be extended without having tines interfere with a front post of a wing plow (at the rear) and without having the mounting channel of the tines interfere with the forward trip springs of the primary moldboard 202. To have the snow discharged beyond the trail of the tire of the vehicle and beyond the intake end of the wing plow, the secondary plow 204 is preferably installed relatively close to the primary moldboard 202. Thus, the discharged snow from secondary plow 202 can be removed from the road and thrown away into the ditch by a wing plow for safer driving in winter months. Secondary plow 204 may be more effectively integrated into an existing plow (e.g., by bringing it closer to the primary moldboard by about 10 inches) without jeopardizing the efficient operation of both the primary moldboard and the secondary plow 204, as well as the tripping device of the primary moldboard 202, by modifying the drive frame. These modifications may include relocating the primary moldboard trip mechanism including replacing the inclined plow lift trip and compression spring with a modified inclined plow lift trip and compression spring arrangement. In addition, a parallel lift for the push frame may be provided and the push frame may be replaced with a push frame having a high bow configuration.

Figure 18:
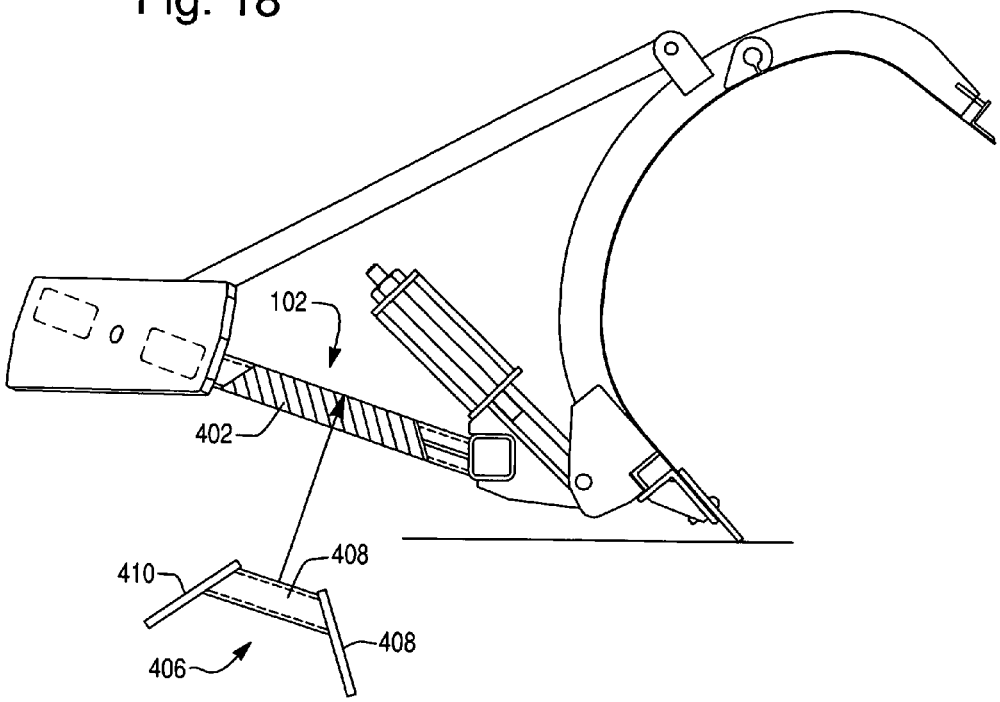
FIG. 18 is a side view of a conventional plow illustrating a modification thereto in connection with a third embodiment of a snow plow.
Figure 19:
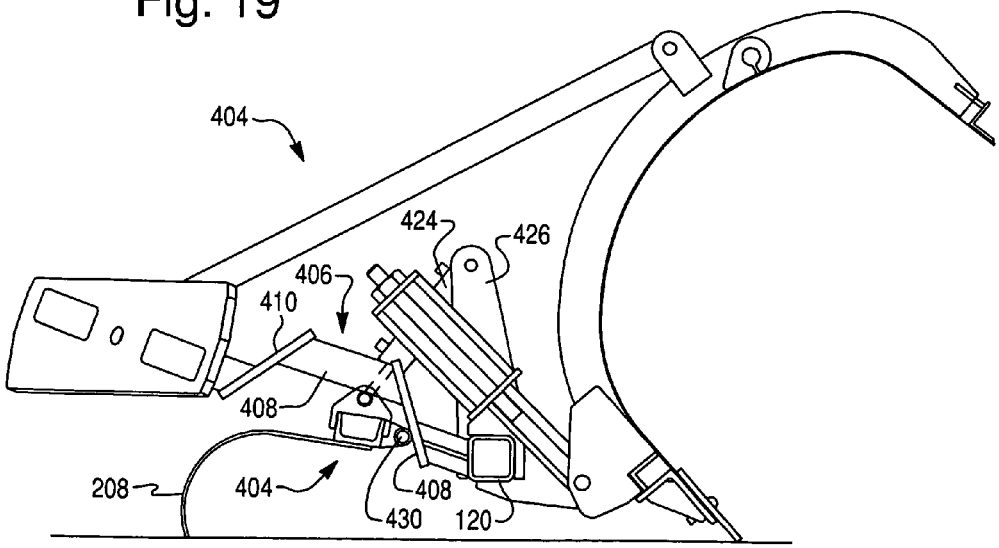
FIG. 19 is a side view of a third embodiment of a snow plow.

FIGS. 18-19 illustrate an example of a secondary plow 404 fitted to a conventional snow plow, such as the plow illustrated in FIGS. 1-3 (shoes 110 and the associated shoe mounting bracket are not shown). Referring to FIG. 18, the fitting of secondary plow 404 begins with removing a section 402 from truss 102 and replacing it with a modified support structure including support member 406 having end plates 408, 410 and a square tube section bridging plates 408 and 410. Support member 406 effectively provides a raised area in the truss 102 extending over the length of the moldboard's scrapping edge so that the secondary plow 404 may be raised and lowered without interference from truss 102 and independently of moldboard 100. Support member 406 may be welded to truss 102 at plates 408 and 410. Referring to FIG. 19, the mounting and operation of secondary plow 404 is similar to that described for secondary plows 204 and 304. Secondary plow 404, which includes a pair of hydraulic cylinders 424, is configured to rotate tines 408 (or a resilient blade 308) about a rotation bar 430 by operation of hydraulic cylinders 424. Hinge mounts, which retain bar 430 (not shown), may be located on plate 408 and a channel holding tines or a resilient blade. Hydraulic cylinders 424 are attached at a housing end to flanges 426, which are mounted to a square tube 120, and at an actuating end to mounts 415. Flanges may, of course, be mounted to any suitable hard point on the truss. These mounts hold pins for receiving the actuating ends. For reversible plows, e.g., FIG. 9, secondary plow 404 may be configured to slide relative to the truss and may also be fitted with linkages in a similar manner as described above to reposition secondary plow 404 behind moldboard 100. Of course a one-way plow, e.g., FIG. 1 may already have sufficient clearance for operation of secondary plow and thus only relatively minor modification may be needed. In these embodiments, secondary plow 204 may be mounted to a square tube and positioned at an effective distance behind moldboard 202, and fitted with hydraulic cylinders to raise and lower secondary plow.

Hydraulic Circuit for a Plow

Figure 20:
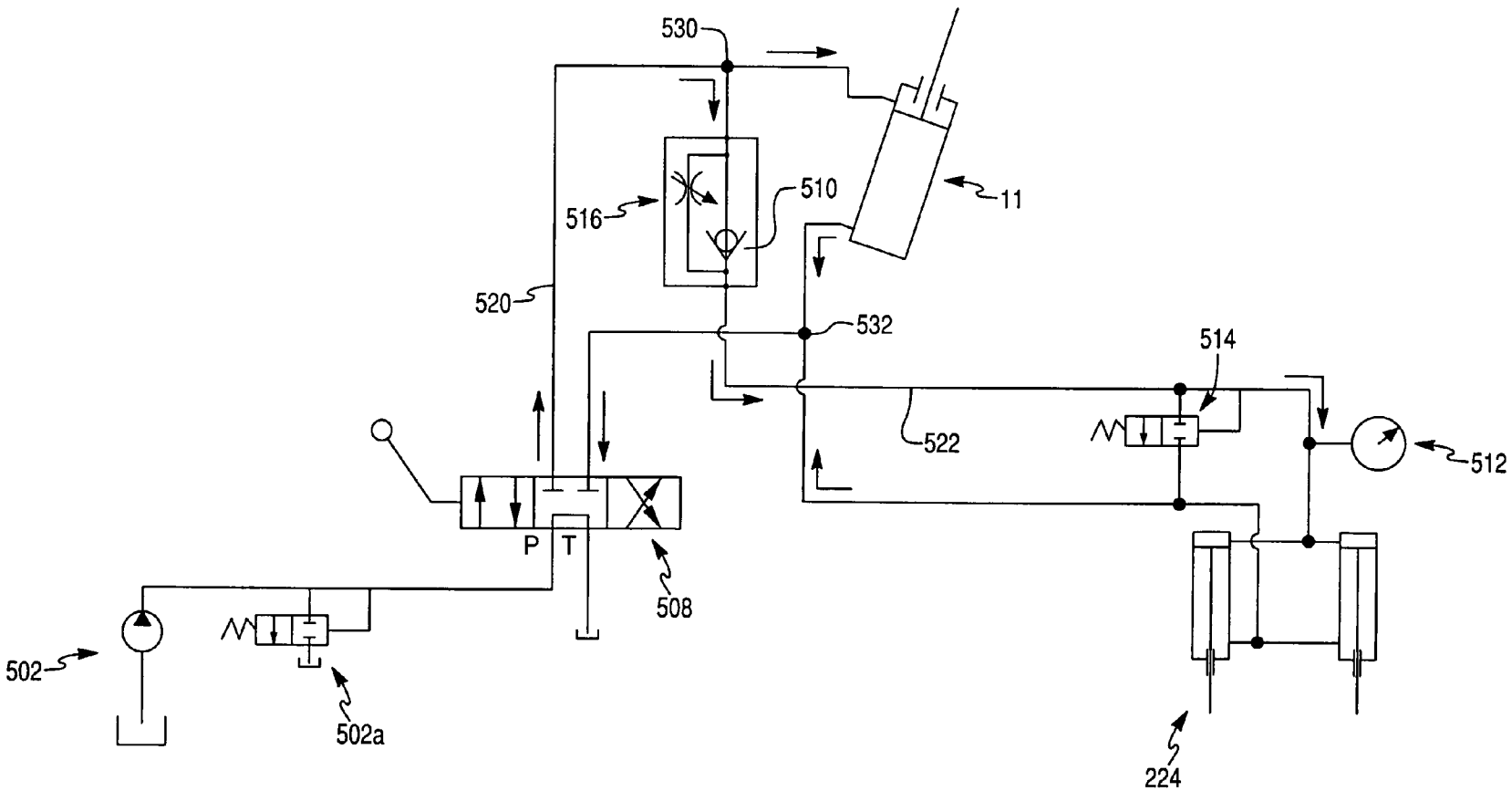
FIG. 20 is a schematic of a hydraulic circuit of the first embodiment of a snow plow.

A hydraulic circuit for a snowplow configured to operate in the manner previously described for the first embodiment, plow 200, will now be described with reference to the FIG. 20. The circuit is used to extend and retract a first double action hydraulic cylinder 11 (see FIG. 4) and a pair of second double action hydraulic cylinders 224 (FIG. 5) which are used to raise and lower moldboard 202 and secondary plow 204, respectively.

When moldboard 202 and secondary plow 204 are in their fully retracted positions, i.e., raised off the ground, the arm of cylinder 224 is fully retracted whereas the arm of cylinder 11 is fully extended. To lower the plows, an operator opens a four-way, three positional directional control valve 508, permitting liquid, e.g., oil, to flow from a reservoir or tank 501 via pump 502, through fluid line 520 and towards cylinders 11 and 224. A pressure relief valve 502*a* is used to limit the fluid pressure generated by pump 502.

As the moldboard 202 is more massive than secondary plow 204, it is preferred to lower moldboard 202 first, followed by secondary plow 204, to avoid damaging secondary plow 204 when moldboard 202 is lowered. This may be accomplished by incorporating a reversible valve 516 which prevents flow towards cylinders 224 until cylinder 11 is filled with fluid, i.e., moldboard 202 is on or near the ground. As cylinder 11 fills with fluid, the pressure above valve 516 increases to a level that causes valve 516 to open. When valve 516 opens, fluid begins to flow into cylinders 224. This delay in the fluid flow into cylinders 224 results in moldboard 202 being lowered first, followed by secondary plow 204. Moldboard 202 and secondary plow 204 may be raised in any order or simultaneously. Thus, the fluid may be emptied from both cylinders 11 and 224 at the same time, pass through a common node 532 and drain into tank. A check valve 510 is opened to allow fluid flow back to the tank ("T" in FIG. 20) from cylinders 11 and 224.

The circuit allows an operator to vary the pressure applied to tines 208. It also gives the operator the option of deploying both moldboard 202 and secondary plow 202, or only moldboard 202 for snow plowing, by monitoring the fluid pressure at input line 522 using a pressure gauge 512. If only moldboard 202 is used for snow plowing, valve 508 is placed into a neutral position when fluid begins to pass through input line 522. If both moldboard 202 and secondary plow 204 are used, the operator allows fluid to enter cylinders 224, thereby deploying secondary plow 204, until an acceptable pressure level is reached that is not too great as to cause damage to the tines 204 and/or roadway but sufficient to lower the tines 204 and adjust the applied pressure as needed.

In another embodiment of a hydraulic circuit, an operator may also have the option of lowering only the secondary plow 204 (e.g., as when a resilient blade is used to remove slush). For example, an additional, one-way valve may be placed in parallel with and upstream of valve 516 with only one of these two valves being in fluid communication with the tank at a given time. If an operator wants to use both the moldboard and secondary plow 204 (or only moldboard 202), valve assembly 516 is used. If an operator only wants to use secondary plow 204, then the additional one-way valve is opened and valve 516 is closed. In the later case, the additional one-valve is both opened and fluid is prevented from entering cylinder 11, thereby causing only secondary plow 204 to lower when valve 508 is opened.

The principles, preferred embodiments and mode of operation of the present invention have been described in the foregoing specification. However, the invention which is intended to be protected is not to be construed as limited to the particular embodiments disclosed. The embodiments are therefore to be regarded as illustrative rather than as restrictive. Variations and changes may be made without departing from the spirit of the present invention. Accordingly, it is expressly intended that all such equivalents, variations and changes which fall within the spirit and scope of the present invention as defined in the claims be embraced thereby.

What is claimed is:

1. A snow plow for mounting to a vehicle, comprising:

a first frame;

a second frame coupled to the first frame for rotation about the first frame;

a main plow having a scraping edge and mounted to the second frame, said main plow having a left end and a right end;

a secondary plow, said secondary plow having a left end and a right end, said secondary plow being positioned behind said main plow; and a member that couples the secondary plow to the second frame, wherein the member is configured to allow translation of the secondary plow relative to the main plow and in a direction that is substantially parallel to the main plow scraping edge so that said left and right ends of said secondary plow are substantially aligned with said respective left and right ends of said main plow.

2. The snow plow of claim 1, further including a linkage having a first end connected to the secondary plow and a second end connected to the first frame.

3. The snow plow of claim 2, wherein when the second frame rotates, the linkage and member cooperate to cause the translation of the secondary plow.

4. The snow plow of claim 3, wherein the linkage is a chain and the member has bearing surfaces located on the second frame that receive the secondary plow.

5. The snow plow of claim 3, wherein the linkage is a first and second chain attached at respective first and second outboard ends of the secondary plow.

6. The snow plow of claim 1, wherein the member is configured so that the secondary plow is decoupled from the second frame in the direction that is parallel to the main plow scraping edge.

7. The snow plow of claim 6, wherein the secondary plow is constrained from movement in the direction that is parallel to the main plow scraping edge by a linkage having a first end connected to the first frame and a second end connected to the secondary plow.

8. The snow plow of claim 7, wherein the linkage is a chain.

9. The snow plow of claim 1, wherein the member includes sleeves receiving the secondary plow and the sleeves include bearing surfaces, wherein the secondary plow slides over the bearing surfaces when the second frame rotates.

10. The snow plow of claim 1, wherein the secondary plow is remotely controllable and independent of the main plow.

11. The snow plow of claim 7, wherein the secondary plow is pivotal relative to the main plow.

12. The snow plow of claim 1, wherein the main plow is coupled to the second frame by a trip mechanism.

13. The snow plow of claim 12, wherein the secondary plow is pivotal about the trip mechanism.

14. The snow plow of claim 12, wherein the trip mechanism comprises a slot disposed on the second frame; and a spring-biased member configured to urge the main plow into a plowing position;

wherein the slot couples the main plow and spring-biased member to the second frame and enables the main plow to deflect away from the plowing position.

15. The snow plow of claim 14, wherein the second frame includes a supporting plate and the slot is formed in the supporting plate.

16. The snow plow of claim 14, wherein the slot is orientated so as to enable the main plow to deflect rearwardly and upwardly away from the plowing position.

17. The snow plow of claim 1, said secondary plow comprising a plurality of fingers, each finger comprising a relatively straight portion which is generally oriented vertically downwardly with respect to the vehicle, each finger also having a curved portion which connects the relatively straight portion to a frame member, said plurality of fingers being adapted for collecting snow, said curved portion extending throughout about 90 degrees extending only from a generally horizontal portion which is connected to the frame member to the relatively straight portion which is generally oriented vertically downwardly with respect to the vehicle, the relatively straight portion being located rearwardly of the frame member during plowing of snow.

18. The snow plow of claim 17, wherein the plurality of fingers are formed by attaching individual fingers to the frame member.

19. The snow plow of claim 17, wherein each of the plurality of fingers is individually bolted to the frame member.

20. The snow plow of claim 19, wherein the curved portion is substantially semi-circular.

21. The snow plow of claim 19, wherein the relatively straight portion of each of the fingers which is generally oriented vertically downwardly with respect to the vehicle, comprises a removable scraping tip.

22. The snow plow of claim 21, wherein each of the removable scraping tips comprises a carbide tip.

23. The snow plow of claim 17, wherein the snow plow is a reversible plow.

24. The snow plow of claim 17 further comprising a remotely controlled actuator, mounted to the vehicle and configured for selectively placing the snow plow into a plowing position.

25. The snow plow of claim 24, wherein the actuator is a hydraulic cylinder.

26. The snow plow of claim 25, wherein the hydraulic cylinder is remotely controllable by a user-enabled valve located within the vehicle.

27. The snow plow of claim 25, wherein the actuator is adapted for selectively rotating the plurality of fingers through a first, second and third angle wherein the first angle is greater than the second angle and the third angle is greater than the second angle, and wherein the first angle corresponds to the fingers being raised above the ground, the second angle corresponds to the fingers touching the ground and the third angle corresponds to the fingers touching the ground after the fingers have eroded.

28. The snow plow of claim 27, further comprising a user-enabled gauge for selecting among the first, second and third angles.

29. A snow plow for mounting to a vehicle, comprising:

a drive frame;

a main plow coupled to the drive frame, said main plow having a left end and a right end;

a secondary plow carried directly by the drive frame and positioned behind the main plow, said secondary plow having a left end and a right end; and, a member that couples the secondary plow to the main plow, wherein the member is configured to allow translation of the secondary plow relative to the main plow and in a direction that is substantially parallel to the main plow so that said left and right ends of said secondary plow are substantially aligned with said respective left and right ends of said main plow;

wherein the secondary plow includes a plurality of fingers, each having a straight portion and a curved portion adapted for collecting snow.

30. The snow plow of claim 29, wherein the plurality of fingers are formed by attaching individual fingers to a support member.

31. The snow plow of claim 29, wherein each of the plurality of fingers includes a curved portion comprising a scraping end and a straight portion including a fastening end.

32. The snow plow of claim 31, wherein the curved portion is substantially semi-circular.

33. The snow plow of claim 31, wherein the scraping end includes a removable scraping tip.

34. The snow plow of claim 33, wherein the scraping tip is a carbide tip.

35. The snow plow of claim 29, wherein the snow plow is a reversible plow.

36. The snow plow of claim 29, wherein the snow plow is a one-way plow, such that the drive frame is pre-configured to orient the main plow at one angle with respect to a plowing direction.

37. The snow plow of claim 36, wherein the one angle is an acute angle.

38. A snow plow for mounting to a vehicle, comprising:

a drive frame;

a main plow coupled to the drive frame, said main plow having a left end and a right end;

a secondary plow coupled directly to the drive frame and positioned behind the main plow, said secondary plow having a left end and a right end;

a member that couples the secondary plow to the main plow, wherein the member is configured to allow translation of the secondary plow relative to the main plow and in a direction that is substantially parallel to the main plow so that said left and right ends of said secondary plow are substantially aligned with said respective left and right ends of said main plow; and a remotely controlled actuator, mounted to the drive frame and configured for selectively placing the secondary plow into a plowing position.

39. The snow plow of claim 38, wherein the actuator is a hydraulic cylinder.

40. The snow plow of claim 39, wherein the hydraulic cylinder is remotely controllable by a user-enabled valve located within a vehicle.

41. The snow plow of claim 39, wherein the main plow is controlled by a first hydraulic cylinder and the secondary plow is controlled by a second hydraulic cylinder, each of which being remotely controllable by an operator-enabled valve.

42. The snow plow of claim 38, wherein when the secondary plow is raised and lowered, the secondary plow pivots about a hinge point of the drive frame.

43. The snow plow of claim 38, wherein the main plow is controlled by a first hydraulic cylinder and the secondary plow is controlled by a second hydraulic cylinder, wherein an actuating end of the second hydraulic cylinder is attached to the secondary plow and an actuating end of the first hydraulic cylinder is attached to the drive frame.

44. The snow plow of claim 38, wherein the secondary plow includes one of a plurality of tines and a resilient blade.

45. The snow plow of claim 44, wherein the actuator is adapted for selectively rotating the plurality of tines through a first, second and third angle wherein the first angle is greater than the second angle and the third angle is greater than the second angle, and wherein the first angle corresponds to the tines raised above the ground, the second angle corresponds to the tines touching the ground and the third angle corresponds to the tines touching the ground after the tines have eroded.

46. The snow plow of claim 45, further including a user-enabled gauge for selecting among the first, second and third angles.

47. A snow plow for mounting to a vehicle, comprising:

a first frame;

a second frame coupled to the first frame for rotation about the first frame;

a main plow having a scraping edge and mounted to the second frame, said main plow having a left end and a right end;

a secondary plow, said secondary plow having a left end and a right end, said secondary plow being positioned behind said main plow; and a member that couples the secondary plow to the second frame, wherein the member is configured to allow translation of the secondary plow relative to the main plow and in a direction that is substantially horizontal and substantially parallel to the main plow scraping edge so that said left and right ends of said secondary plow are substantially aligned with said respective left and right ends of said main plow.

48. A snow plow for mounting to a vehicle, comprising:

a first frame;

a second frame coupled to the first frame for rotation about the first frame;

a main plow having a scraping edge and mounted to the second frame, said main plow having a left end and a right end;

a secondary plow, said secondary plow having a left end and a right end, said secondary plow being positioned behind said main plow; and a member that couples the secondary plow to the second frame, wherein the member is configured to allow translation of the secondary plow relative to the main plow and in a direction that is substantially horizontal and substantially parallel to the main plow scraping edge so that said left and right ends of said secondary plow are substantially aligned with said respective left and right ends of said main plow, said secondary plow comprising a plurality of fingers, each finger comprising a relatively straight portion which is generally oriented vertically downwardly with respect to the vehicle, each finger also having a curved portion which connects the relatively straight portion to a frame member, said plurality of fingers being adapted for collecting snow, said curved portion extending throughout about 90 degrees extending only from a generally horizontal portion which is connected to the frame member to the relatively straight portion which is generally oriented vertically downwardly with respect to the vehicle, the relatively straight portion being located rearwardly of the frame member during plowing of snow.

49. A snow plow for mounting to a vehicle, comprising:

a drive frame;

a main plow coupled to the drive frame, said main plow having a left end and a right end;

a secondary plow carried directly by the drive frame and positioned behind the main plow, said secondary plow having a left end and a right end; and a member that couples the secondary plow to the main plow, wherein the member is configured to allow translation of the secondary plow relative to the main plow and in a direction that is substantially parallel to the main plow so that said left and right ends of said secondary plow are substantially aligned with said respective left and right ends of said main plow;

wherein the secondary plow includes a plurality of fingers, each finger comprising a relatively straight portion which is generally oriented vertically downwardly with respect to the vehicle, each finger also having a curved portion which connects the relatively straight portion to a frame member, said plurality of fingers being adapted for collecting snow, said curved portion extending throughout about 90 degrees extending only from a generally horizontal portion which is connected to the frame member to the relatively straight portion which is generally oriented vertically downwardly with respect to the vehicle, the relatively straight portion being located rearwardly of the frame member during plowing of snow.

* * * * *